US010023942B2

(12) United States Patent
Schutz et al.

(10) Patent No.: US 10,023,942 B2
(45) Date of Patent: Jul. 17, 2018

(54) TITANIUM ALLOY, PARTS MADE THEREOF AND METHOD OF USE

(71) Applicant: RTI International Metals, Inc., Niles, OH (US)

(72) Inventors: Ronald W. Schutz, Canfield, OH (US); Birendra C. Jena, Niles, OH (US)

(73) Assignee: Arconic Inc., Pittsburgh, PA (US)

( * ) Notice: Subject to any disclaimer, the term of this patent is extended or adjusted under 35 U.S.C. 154(b) by 0 days.

(21) Appl. No.: 14/647,622

(22) PCT Filed: Apr. 28, 2015

(86) PCT No.: PCT/US2015/028003
§ 371 (c)(1),
(2) Date: May 27, 2015

(87) PCT Pub. No.: WO2015/168131
PCT Pub. Date: Nov. 5, 2015

(65) Prior Publication Data

US 2016/0258040 A1 Sep. 8, 2016

Related U.S. Application Data

(60) Provisional application No. 61/985,133, filed on Apr. 28, 2014.

(51) Int. Cl.
*C22C 14/00* (2006.01)
*E21B 17/00* (2006.01)

(52) U.S. Cl.
CPC ..... *C22C 14/00* (2013.01); *E21B 17/00* (2013.01)

(58) Field of Classification Search
CPC ..... C22C 14/00; E21B 17/00
USPC ..... 420/420
See application file for complete search history.

(56) References Cited

U.S. PATENT DOCUMENTS

| | | | | |
|---|---|---|---|---|
| 4,859,415 | A * | 8/1989 | Shida et al. | 420/417 |
| 5,041,262 | A | 8/1991 | Gigliotti, Jr. | |
| 6,582,833 | B2 | 6/2003 | Toyoda et al. | |
| 8,337,750 | B2 | 12/2012 | Jablokov et al. | |
| 2003/0168138 | A1 | 9/2003 | Marquardt | |
| 2010/0322817 | A1 | 12/2010 | Sakashita et al. | |
| 2013/0164168 | A1 | 6/2013 | Tetyukhin et al. | |

FOREIGN PATENT DOCUMENTS

| | | | |
|---|---|---|---|
| DE | 19533743 | A1 | 3/1997 |
| EP | 0851036 | A1 | 7/1998 |
| EP | 1634971 | A2 | 3/2006 |
| EP | 2078760 | A1 | 7/2009 |
| GB | 2198144 | A | 6/1988 |
| WO | 2001011095 | | 2/2001 |
| WO | 02090607 | A1 | 11/2002 |

OTHER PUBLICATIONS

European Search Report (EP 15785859.8) dated Nov. 7, 2017, (6 pages).

* cited by examiner

*Primary Examiner* — Helene Klemanski
(74) *Attorney, Agent, or Firm* — Greenberg Traurig, LLP

(57) ABSTRACT

A titanium alloy, components formed thereof, and methods of use are provided. Embodiments of the alloy may be useful in the energy extraction environment. Components formed of the alloy may include subsea or land-based components associated with oil and gas production and drilling.

8 Claims, 7 Drawing Sheets

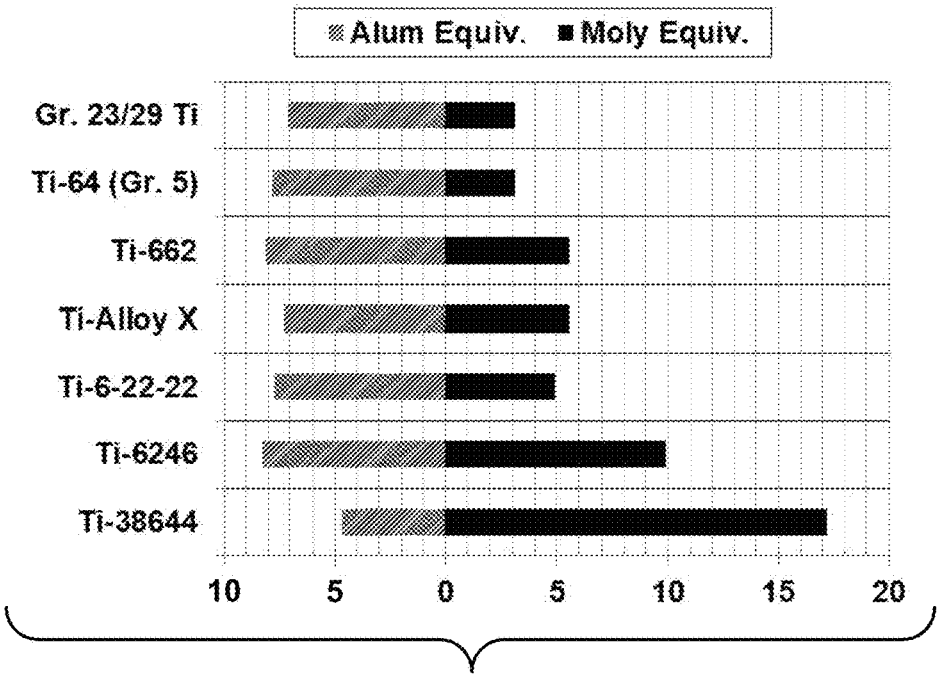
FIG−1
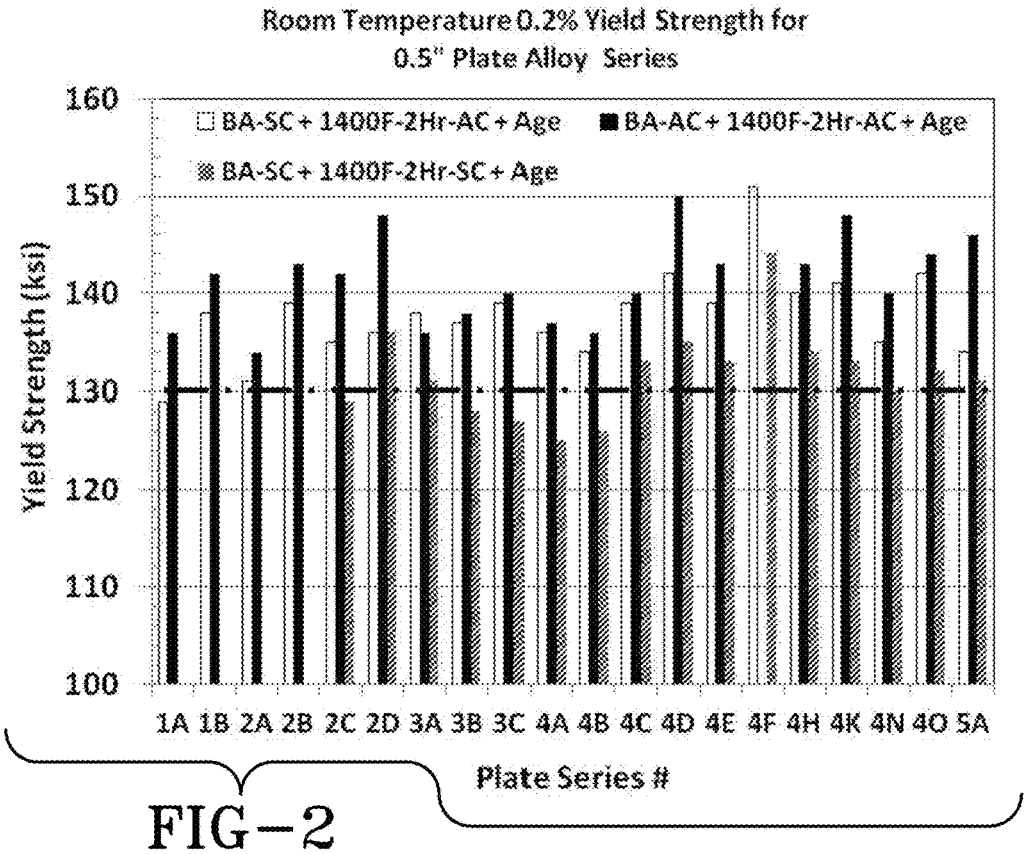
FIG−2

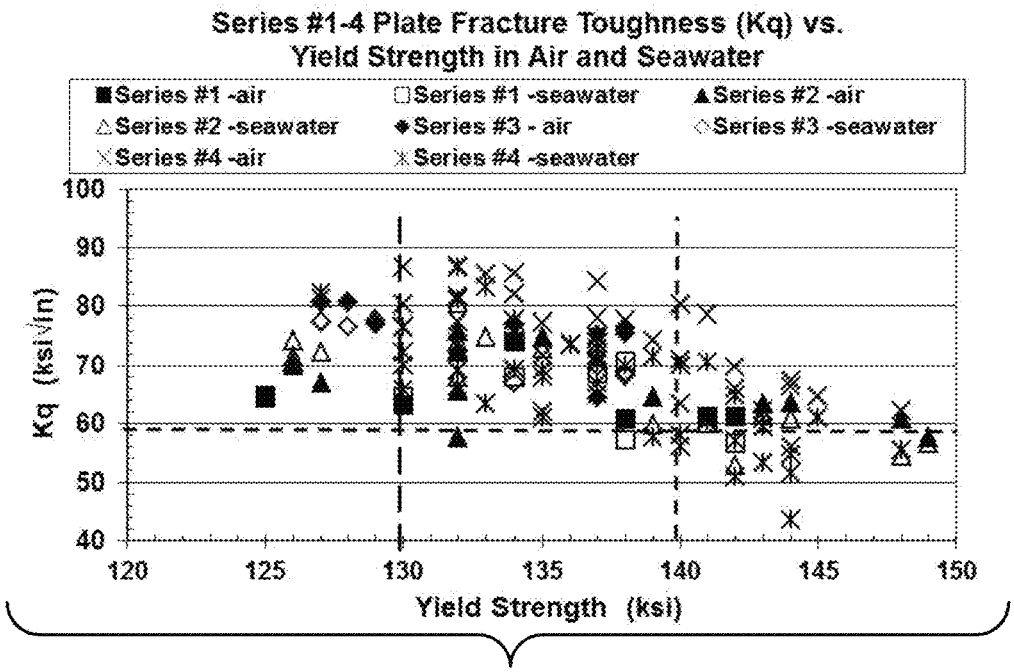
FIG−3
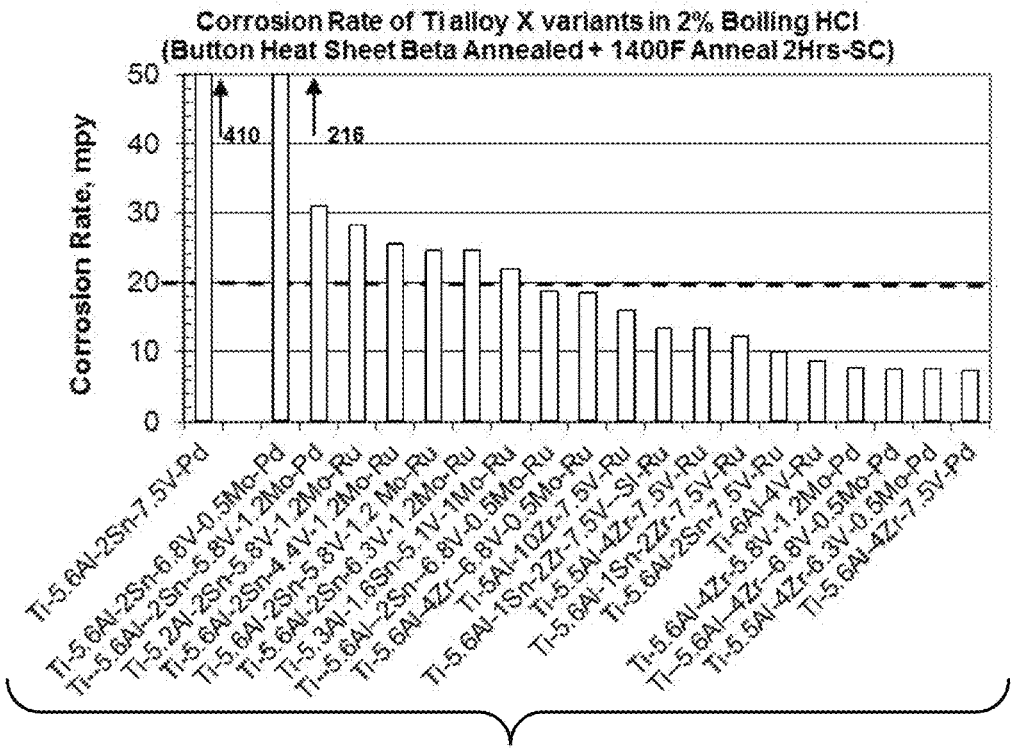
FIG−4

TITANIUM ALLOY, PARTS MADE THEREOF AND METHOD OF USE

CROSS REFERENCE TO RELATED APPLICATIONS

This application is a National Stage of International Application No. PCT/US2015/028003, filed Apr. 28, 2015, which claims priority to U.S. Provisional Application Ser. No. 61/985,133, filed Apr. 28, 2014, the disclosures of which are incorporated herein by reference.

BACKGROUND

Technical Field

The technical field relates to titanium alloys, components formed therefrom and methods of using such components.

Background Information

Increasing worldwide demand for energy continues to drive extraction/recovery of energy sources to more challenging frontiers, often involving engineering material limitations. This is exemplified in the extraction of geothermal energy and hydrocarbons (i.e., oil/gas), whereby it is necessary to pursue ever deeper fields and wells, on land and in deeper offshore waters, encountering correspondingly higher temperatures and pressures, and more aggressive, corrosive environments. Hydrocarbon reservoirs/wells have been classified as high-pressure/high-temperature (HPHT) when bottomhole temperatures exceed approximately 300° F. and 10,000 pounds per square inch (psi) pressure. Extreme HPHT (XHPHT) wells are those exceeding about 400° F. and 20,000 psi bottomhole pressure. These hot, and often deep, well reservoirs typically produce a mixture of hydrocarbons and aqueous well fluids, including chloride-containing brines pressurized with acidic gases such as carbon dioxide ($CO_2$) and/or hydrogen sulfide ($H_2S$). Wells are now being drilled to total depths of 50,000 feet and beyond where temperature and/or pressure increasingly elevate. Geothermal wells used for energy extraction and power generation are generally shallower with correspondingly lower bottomhole pressures, but can produce very high temperature (e.g., as high as 625° F.) sweet or sour highly-saline brines which are highly corrosive to conventional metallic materials.

Higher strength and fully corrosion resistant alloys for various well components, such as the production tubing string and casing, wellhead valves, bottom well liner, and well logging housing and fluid sampling vessels are required to successfully handle these often sour ($H_2S$-containing) HPHT/XHPHT well fluids. In addition to these downhole well components, offshore hydrocarbon production must consider appropriate production riser tubular strings and components to convey these aggressive HPHT well fluids from the seafloor to the offshore platform. In addition to elevated corrosion resistance, the trend toward field development in deeper and ultra-deep (>5,000 ft. depth) waters also requires higher strength and lighter weight tubular strings for production, export, and re-injection offshore risers, as well as well-workover and/or landing strings. Traditional engineering corrosion resistant alloys or CRAs (e.g., stainless steels and nickel-base alloys) have limited utilization in these situations due to their relatively lower strengths and higher densities (i.e., lower strength-to-density ratios). Even higher strength steel—e.g., high-strength low-alloy (HSLA) steel with up to 150-160 ksi (kilopounds per square inch) minimum yield strength—tubular strings can become too heavy to hang in ultra-deep offshore waters in certain scenarios or in deep oil and gas wells.

In recent years, several higher strength titanium alloys have found successful application in these energy industry arenas over the past 15 years due to various desirable characteristics such as high strength and low densities resulting in elevated strength-to-density ratios (i.e., lightweight structures), elevated corrosion resistance to aqueous chloride fluids (seawater, well fluid brines) and $H_2S$ and $CO_2$ acid gases, lower elastic modulus (high flexibility), and excellent air and saltwater fatigue resistance (desirable for dynamic offshore riser components). These include use of Ti-38644 (ASTM Grade 19) beta-titanium alloy in various downhole tubular strings and well jewelry in hydrocarbon and geothermal wells, Ti-64 ELI (ASTM Grade 23 Ti) in an offshore drilling riser, and Ti-64-Ru (ASTM Grade 29 Ti) as titanium stress joints in catenary and top-tensioned steel offshore riser top and bottom terminations and as hypersaline-brine geothermal well production casings in the Salton Sea. More recently, the Ti-6246 alloy has been tested and qualified for oil country tubular goods (OCTG) production tubulars for high temperature sour well service by Chevron.

Traditional, commercial titanium alloys are either: 1) relatively low strength (25-100 ksi yield strength or YS) which are generally used for chemical, power generation, and industrial processes; or 2) higher strength (110-180 ksi YS) alloys designed primarily for high strength-to-weight ratios to achieve lightweight, structurally-efficient aerospace airframes and engine components. Unfortunately, with limited past need for enhanced resistance to halide-containing chemicals, seawater, and various cold or hot brines, these traditional higher-strength aerospace titanium alloys were not designed or intended to resist localized corrosion attack or stress corrosion cracking (SCC) in aqueous chloride media, particularly at higher temperatures and/or lower pH environments. As such, most of these alloys exhibit unacceptably low saltwater fracture toughness ($K_{SCC}$) values in saltwater and other aqueous chloride fluids, failing to meet fracture mechanics requirement for highly stressed components.

Table 1 in part provides an overview comparison of positive features vs. limitations of higher-strength (≥110 ksi YS) commercial titanium alloys considered and/or used for these energy extraction applications. It can be seen that although the three alloys approved under the ANSI/NACE MR0175/ISO 15156 Standard for sour service (Ti-64-Ru, Ti-6246, Ti-38644) offer varying degrees of hot aqueous chloride/brine resistance, they exhibit other crucial limitations in strength (Ti-64-Ru) especially as temperature increases, or in fusion weldability (Ti-6246 and Ti-38644). Ti-6246 alloy components exhibit relatively low fracture toughness values (precluding their use in offshore risers, or well-workover and landing strings), which are further diminished in aqueous chloride media. The other four alloys are highly susceptible to localized attack and SCC in halide (e.g., chloride-containing) brines, particularly as temperatures increase, and/or are limited in their weldability. The need for fusion-weldability (e.g., gas tungsten arc or GTA welding, gas metal arc or GMA welding, and plasma welding) is primarily a requirement for fabrication of offshore risers and possibly drilling components, and is not relevant for downhole well/OCTG components where seamless products are generally used.

Improving the corrosion resistance of various commercial high-strength alpha-beta and beta titanium alloys through minor PGM (platinum group metal) alloy additions (i.e., Pd or Ru) for hot sour, chloride-rich oil/gas well service has been investigated and documented, for instance in U.S. Pat. No. 4,859,415 granted to Shida et al. It was demonstrated that minor (≤0.15 wt. %) Pd and Ru additions to various high-strength commercial alloys such as Ti-6Al-4V, Ti-6Al-2Sn-4Zr-2Mo, Ti-6Al-6V-2Sn, Ti-6246, and Ti-38644 can measurably elevate threshold temperatures for chloride crevice attack and SCC in deaerated, sour, deep-well brine fluids at higher temperatures. This benefit stems from localized alloy ennoblement and repassivation from these PGMs in hot reducing acid chloride media formed within crevices and cracks to counter the anodic acid-chloride corrosion mechanism.

Unfortunately, this PGM alloy ennoblement effect cannot effectively counter/prevent SCC at lower temperatures (e.g., at room temperature—about 77° F.) in aqueous chloride media, where mixed cathodic/hydrogen embrittlement and/or anodic chloride mechanisms can prevail. In fact, if a titanium alloy has a relatively high aluminum equivalency (i.e., Al+O content) and incurs substantial alpha-two ($Ti_3Al$) compound precipitation, the Ru or Pd alloy additions merely serve to further aggravate chloride SCC and produce low $K_{SCC}$ values. With the exception of the Ti-38644 (beta) alloy listed prior, all of the remaining commercial alpha-beta alloys mentioned can be expected to suffer low fracture toughness ($K_{SCC}$ values) in aerated or deaerated saltwater and brines over a wide temperature range. This negative PGM addition effect can be avoided by adding minor Ru or Pd levels to a lower Aluminum Equivalency (lower Al+O containing) titanium alloy such as Ti-3Al-2.5V (Gr. 9 Ti) or Ti-6Al-4V ELI (Gr. 23 Ti) to produce ASTM Grades 28 and 29 Ti, respectively; which do offer favorable saltwater fracture toughness (i.e., high $K_{SCC}$ values). Unfortunately, reducing the Al+O alloy content sufficiently to minimize or avoid alpha-two precipitation also results in alpha or alpha-beta alloys possessing relatively low strengths (YS≤110 ksi).

As shown in Table 1, although the Ti-6Al-4V-Ru (ASTM Gr. 29) alloy is highly weldable, fracture resistant, and offers exceptional hot brine corrosion resistance to 600° F., the alloy's lower design yield strength (YS) of 110 ksi and significant degradation of YS with increasing temperature (e.g., 78 ksi at 500° F.) translate into a substantial tubular wall thickness increase and weight penalty particularly as HPHT/XHPHT service temperatures exceed ~300° F. Table 1 shows various higher-strength (more highly alloyed) commercial alpha-beta titanium alloys offering a 130 ksi minimum YS in the fully transformed-beta plus STA condition, and exhibiting limited finite fusion weldability. While Table 1 shows that the Ti-662 alloy has some desirable characteristics, this classic aerospace alloy exhibits very poor/limited resistance to localized corrosion attack and stress corrosion cracking (i.e., low $K_{SCC}$) in aqueous chloride media, especially as temperature increases. In addition, Ti-662 nominally contains 0.6 wt. % Fe and 0.6 wt. % Cu (for increased aged strength), which can cause substantial elemental micro- and macro-segregation/inhomogeneities during melting of larger ingots needed for energy industry components. As overviewed in Table 1, the inventors are unaware of any prior commercially-available higher strength titanium alloys which meet various criteria desired for successful use in the field of energy extraction.

SUMMARY

In one aspect, a titanium alloy may consist essentially of aluminum from 5.0 to 6.0% by weight; zirconium from 3.75 to 4.75% by weight; vanadium from 5.2 to 6.2% by weight; molybdenum from 1.0 to 1.7% by weight; one of palladium from 0.04 to 0.20% by weight and ruthenium from 0.06 to 0.20% by weight; and a titanium remainder balance.

In another aspect, a method may comprise the steps of providing a component formed of a titanium alloy consisting essentially of, by weight, 5.0 to 6.0% aluminum, 3.75 to 4.75% zirconium, 5.2 to 6.2% vanadium, 1.0 to 1.7% molybdenum, one of 0.04 to 0.20% palladium and 0.06 to 0.20% ruthenium, and a balance titanium; and operating or maintaining a production and/or extraction system comprising the component while the component is in contact with aqueous chloride media.

BRIEF DESCRIPTION OF THE SEVERAL VIEWS OF THE DRAWINGS

One or more sample embodiments are set forth in the following description, and may be shown in the drawings and particularly and distinctly pointed out and set forth in the appended claims.

FIG. 1 is a graph showing relative alpha (aluminum equivalency) versus beta (molybdenum equivalency) alloying content for Ti Alloy X (defined below) compared to other commercial titanium alloys.

FIG. 2 is a graph showing room temperature yield strength of 0.5" plate alloy series #1-5 (detailed further below) at BA-SC and BA-AC plus STA conditions.

FIG. 3 is a graph showing series #1-4 plate fracture toughness versus yield strength in air and seawater.

FIG. 4 is a graph showing corrosion rates of series #1-5 Ti alloy button heat sheet base metal exposed to boiling 2 Wt. % HCl solution for initial screening of relative hot reducing acid chloride resistance.

Similar numbers refer to similar parts throughout the drawings.

DETAILED DESCRIPTION

Figure 5:
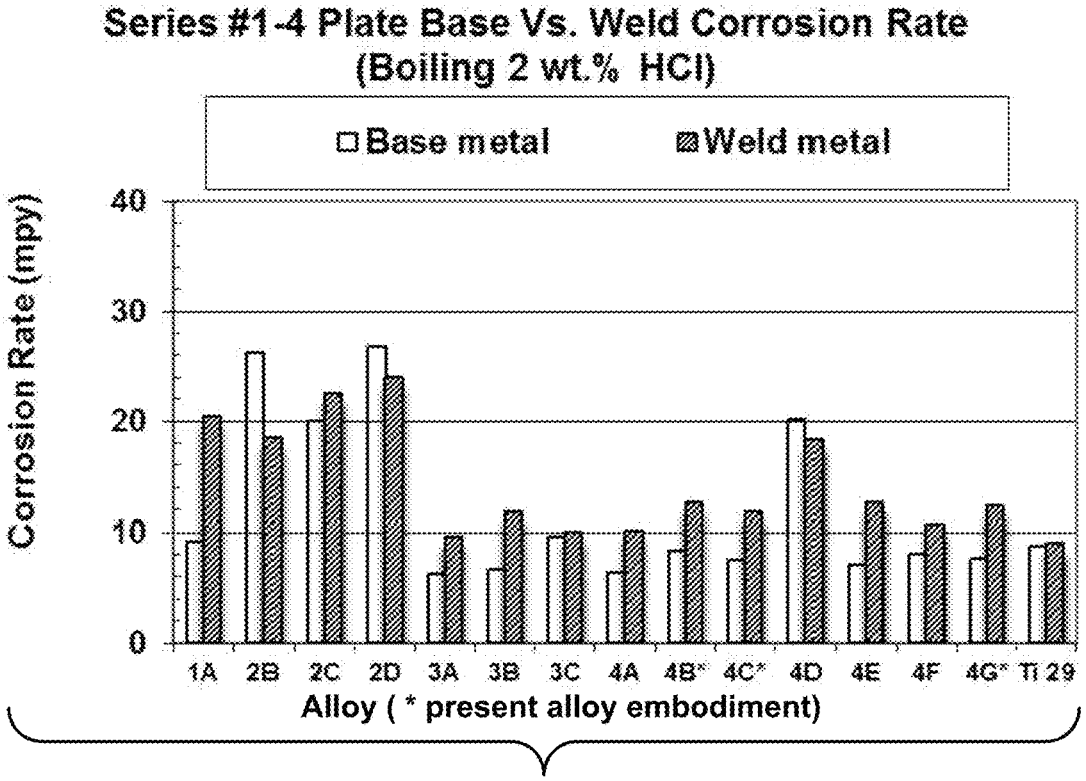
FIG. 5 is a graph showing series #1-4 alloy base and weld metal corrosion rates in boiling 2 Wt. % HCl solution, as compared to Grade 29 titanium.

Generally, embodiments of the present alloy may comprise or consist essentially of about aluminum (Al) from 5.0 to 6.0% by weight, zirconium (Zr) from 375 to 475% by weight, vanadium (V) from 5.2 to 6.2% by weight, molybdenum (Mo) from 1.0 to 1.7% by weight, one of palladium (Pd) from 0.04 to 0.20% by weight and ruthenium (Ru) from 0.06 to 0.20% by weight, and a balance titanium (Ti) with incidental impurities. Percentages of various other elements which may be included in various embodiments of the present alloy are discussed in greater detail below. Unless otherwise noted, all percentages herein are given by weight or weight percent (wt. %).

The titanium alloy may comprise aluminum (Al) from 5.0 to 6.0% by weight, from 5.1 to 5.9% by weight, from 5.2 to 5.8% by weight, from 5.3 to 5.7% by weight, from 5.4 to 5.6% by weight, and in one embodiment may be about 5.5% by weight. More generally, the alloy may comprise aluminum in a weight percent range defined between any two of the numbers 5.0, 5.1, 5.2, 5.3, 5.4, 5.5, 5.6, 5.7, 5.8, 5.9 and 6.0. By way of non-limiting example, the alloy may comprise aluminum in a range of 5.1 to 5.8% by weight, or 5.3 to 5.7% by weight, or 5.0 to 5.5% by weight, or 5.0 to 5.4% by weight, or 5.6 to 5.9% by weight, etc.

The titanium alloy may comprise zirconium (Zr) from 3.75 to 4.75% by weight, or from 3.8 to 4.7% by weight, or from 3.9 to 4.6% by weight, or from 4.0 to 4.5% by weight, or from 4.1 to 4.4% by weight, or from 4.1 to 4.3% by weight, and in one embodiment may be about 4.25% by weight. More generally, the alloy may comprise zirconium in a weight percent range defined between any two of the numbers 3.75, 3.8, 3.9, 4.0, 4.1, 4.2, 4.25, 4.3, 4.4, 4.5, 4.6, 4.7 and 4.75. By way of nonlimiting example, the alloy may comprise zirconium in a range of 3.8 to 4.6% by weight, or 3.9 to 4.5% by weight, or 4.25 to 4.7% by weight, or 3.75 to 4.4% by weight, or 4.3 to 4.6% by weight, etc.

The titanium alloy may comprise vanadium (V) from 5.2 to 6.2% by weight, or from 5.3 to 6.1% by weight, or from 5.4 to 6.0% by weight, or from 5.5 to 5.9% by weight, or from 5.6 to 5.8% by weight, and in one embodiment may be about 5.7% by weight. More generally, the alloy may comprise vanadium in a weight percent range defined between any two of the numbers 5.2, 5.3, 5.4, 5.5, 5.6, 5.7, 5.8, 5.9, 6.0, 6.1 and 6.2, such that specific examples will be understood from the non-limiting examples provided above with respect to aluminum and zirconium.

The titanium alloy may comprise molybdenum (Mo) from 1.0 to 1.7% by weight, or from 1.1 to 1.5 or 1.6 or 1.7% by weight, or from 1.2 to 1.3 or 1.4% by weight, and in one embodiment may be about 1.25% by weight. More generally, the alloy may comprise molybdenum in a weight percent range defined between any two of the numbers 1.0, 1.1, 1.2, 1.3, 1.4, 1.5, 1.6 and 1.7, such that specific examples will be understood from the non-limiting examples provided above with respect to aluminum and zirconium.

The titanium alloy may comprise one of palladium (Pd) from 0.04 to 0.20% by weight and ruthenium (Ru) from 0.06 to 0.20% by weight. The titanium alloy may comprise palladium (Pd) from 0.04 or 0.05 to 0.07 or 0.08 or 0.09 or 0.10 or 0.11 or 0.12 or 0.13 or 0.14 or 0.15 or 0.16 or 0.17 or 0.18 or 0.19 or 0.20% by weight, and in one embodiment may be about 0.06% by weight. More generally, the alloy may comprise palladium in a weight percent range defined between any two of the numbers 0.04, 0.05, 0.06, 0.07, 0.08, 0.09, 0.10, 0.11, 0.12, 0.13, 0.14, 0.15, 0.16, 0.17, 0.18, 0.19 and 0.20% by weight, as will be understood from the above non-limiting examples.

The titanium alloy may comprise ruthenium (Ru) from 0.06 or 0.07 or 0.08 to 0.10 or 0.11 or 0.12 or 0.13 or 0.14 or 0.15 or 0.16 or 0.17 or 0.18 or 0.19 or 0.20% by weight, and in one embodiment may be about 0.09% by weight. More generally, the alloy may comprise ruthenium in a weight percent range defined between any two of the numbers 0.06, 0.07, 0.08, 0.09, 0.10, 0.11, 0.12, 0.13, 0.14, 0.15, 0.16, 0.17, 0.18, 0.19 and 0.20% by weight, as will be understood from the above non-limiting examples.

It may be that the titanium alloy comprises no more than 0.25% iron (Fe) by weight, and may comprise iron from 0.0 or 0.01 or 0.02 to 0.25% by weight, or from 0.03 or 0.04 or 0.05 to 0.24% by weight, or from 0.06 or 0.7 or 0.08 to 0.23% by weight, or from 0.09 or 0.10 to 0.20 or 0.21 or 0.22% by weight, or from 0.11 to 0.19% by weight, or from 0.12 to 0.18% by weight, or from 0.13 to 0.17% by weight, or from 0.14 to 0.16% by weight, and in one embodiment may be about 0.15% by weight. More generally, the alloy may comprise iron in a weight percent range defined between any two of the numbers 0.0, 0.01, 0.02, 0.03, 0.04, 0.05, 0.06, 0.07, 0.08, 0.09, 0.10, 0.11, 0.12, 0.13, 0.14, 0.15, 0.16, 0.17, 0.18, 0.19, 0.20, 0.21, 0.22, 0.23, 0.24 and 0.25, as will be understood from the above examples.

Oxygen, nitrogen, carbon, hydrogen and boron may be interstitial elements of the alloy. It may be that the titanium alloy comprises no more than 0.13% oxygen (O) by weight, and in one embodiment may be about 0.10% by weight. It may be that the titanium alloy comprises no more than 0.05% nitrogen (N) by weight. It may be that the titanium alloy comprises no more than 0.03% carbon (C) by weight. It may be that the titanium alloy comprises no more than 0.015% hydrogen (H) by weight. It may be that the titanium alloy comprises no more than 0.015 wt. % boron (B) and may comprise boron by weight no more than 0.010, 0.009, 0.008, 0.007, 0.006, 0.005, 0.0045, 0.004, 0.0035, 0.003, 0.0025, 0.002, 0.0015, 0.001, 0.0005, 0.0004, 0.0003, 0.0002 or 0.0001%.

The titanium alloy may comprise titanium (Ti) within a range of about 75.0 or 76.0 or 77.0 or 78.0 or 79.0 or 80.0 or 81.0 to about 83.0 or 84.0 or 85.0% by weight, and in one embodiment may be within a range of about 80.5 to about 84.8% by weight, and may be about 82.9% by weight. More generally, the alloy may comprise titanium in a weight percent range defined between any two of the numbers above in this paragraph.

It may be that the titanium alloy comprises no more than 0.20 wt. % yttrium (Y) and may comprise yttrium by weight no more than 0.15, 0.10, 0.05, 0.04, 0.03, 0.02, 0.015, 0.01, 0.005 or 0.001%. The alloy may comprise yttrium in a weight percent range defined between any two of the numbers 0.20, 0.15, 0.10, 0.05, 0.04, 0.03, 0.02, 0.015, 0.01, 0.005, 0.001 and 0.0.

It may be that the titanium alloy comprises no more than 0.10 wt. % silicon (Si) and may comprise silicon by weight no more than 0.09, 0.08, 0.07, 0.06, 0.05, 0.04, 0.03, 0.02, 0.01, 0.005 or 0.001%. The alloy may comprise silicon in a weight percent range defined between any two of the numbers 0.10, 0.09, 0.08, 0.07, 0.06, 0.05, 0.04, 0.03, 0.02, 0.01, 0.005, 0.001 and 0.0.

It may be that the titanium alloy comprises no more than 1.0 wt % tin (Sn) and may comprise tin by weight no more than 0.9, 0.8, 0.7, 0.6, 0.5, 0.4, 0.3, 0.2, 0.1, 0.05 or 0.01%. The alloy may comprise tin in a weight percent range defined between any two of the numbers 1.0, 0.9, 0.8, 0.7, 0.6, 0.5, 0.4, 0.3, 0.2, 0.1, 0.05, 0.01 and 0.0. When the alloy contains palladium in the amount noted above, the alloy may comprise tin by weight no more than 0.25, 0.2, 0.15, 0.1, 0.09, 0.08, 0.07, 0.06, 0.05, 0.04, 0.03, 0.02, 0.01, 0.005 or 0.001%, and may comprise tin in a weight percent range defined between any two of the numbers 0.25, 0.2, 0.15, 0.1, 0.09, 0.08, 0.07, 0.06, 0.05, 0.04, 0.03, 0.02, 0.01, 0.005, 0.001 and 0.0.

It may be that the titanium alloy comprises no more than 0.25 wt. % chromium (Cr) and may comprise chromium by weight no more than 0.2, 0.15, 0.1, 0.09, 0.08, 0.07, 0.06, 0.05, 0.04, 0.03, 0.02, 0.01, 0.005 or 0.001%. The alloy may comprise chromium in a weight percent range defined between any two of the numbers 0.25, 0.2, 0.15, 0.1, 0.09, 0.08, 0.07, 0.06, 0.05, 0.04, 0.03, 0.02, 0.01, 0.005, 0.001 and 0.0.

It may be that the titanium alloy comprises no more than 0.25 wt. % manganese (Mn) and may comprise manganese by weight no more than 0.2, 0.15, 0.1, 0.09, 0.08, 0.07, 0.06, 0.05, 0.04, 0.03, 0.02, 0.01, 0.005 or 0.001%. The alloy may comprise manganese in a weight percent range defined between any two of the numbers 0.25, 0.2, 0.15, 0.1, 0.09, 0.08, 0.07, 0.06, 0.05, 0.04, 0.03, 0.02, 0.01, 0.005, 0.001 and 0.0.

It may be that the titanium alloy comprises no more than 0.20 Wt. % zinc (Zn) and may comprise zinc by weight no more than 0.15, 0.1, 0.09, 0.08, 0.07, 0.06, 0.05, 0.04, 0.03, 0.02, 0.01, 0.005 or 0.001%. The alloy may comprise zinc in a weight percent range defined between any two of the numbers 0.2, 0.15, 0.1, 0.09, 0.08, 0.07, 0.06, 0.05, 0.04, 0.03, 0.02, 0.01, 0.005, 0.001 and 0.0.

It may be that the titanium alloy comprises no more than 0.20 wt. % copper (Cu) and may comprise copper by weight no more than 0.15, 0.1, 0.09, 0.08, 0.07, 0.06, 0.05, 0.04, 0.03, 0.02, 0.01, 0.005 or 0.001%. The alloy may comprise copper in a weight percent range defined between any two of the numbers 0.2, 0.15, 0.1, 0.09, 0.08, 0.07, 0.06, 0.05, 0.04, 0.03, 0.02, 0.01, 0.005, 0.001 and 0.0.

It may be that the titanium alloy comprises no more than 0.20 wt. % nickel (Ni) and may comprise nickel by weight no more than 0.15, 0.1, 0.09, 0.08, 0.07, 0.06, 0.05, 0.04, 0.03, 0.02, 0.01, 0.005 or 0.001%. The alloy may comprise nickel in a weight percent range defined between any two of the numbers 0.2, 0.15, 0.1, 0.09, 0.08, 0.07, 0.06, 0.05, 0.04, 0.03, 0.02, 0.01, 0.005, 0.001 and 0.0.

It may be that the titanium alloy comprises no more than 0.20 wt. % cobalt (Co) and may comprise cobalt by weight no more than 0.15, 0.1, 0.09, 0.08, 0.07, 0.06, 0.05, 0.04, 0.03, 0.02, 0.01, 0.005 or 0.001%. The alloy may comprise cobalt in a weight percent range defined between any two of the numbers 0.2, 0.15, 0.1, 0.09, 0.08, 0.07, 0.06, 0.05, 0.04, 0.03, 0.02, 0.01, 0.005, 0.001 and 0.0.

11 may be that the titanium alloy comprises no more than 0.5 wt. % tungsten (W) and may comprise tungsten by weight no more than 0.4, 0.3, 0.2, 0.1, 0.1, 0.09, 0.08, 0.07, 0.06, 0.05, 0.04, 0.03, 0.02, 0.01, 0.005 or 0.001%. The alloy may comprise tungsten in a weight percent range defined between any two of the numbers 0.5, 0.4, 0.3, 0.2, 0.1, 0.1, 0.09, 0.08, 0.07, 0.06, 0.05, 0.04, 0.03, 0.02, 0.01, 0.005, 0.001 and 0.0.

It may be that the titanium alloy comprises no more than 1.0 wt. % hafnium (Hf) and may comprise hafnium by weight no more than 0.9, 0.8, 0.7, 0.6, 0.5, 0.4, 0.3, 0.2, 0.1, 0.05 or 0.01%. The alloy may comprise hafnium in a weight percent range defined between any two of the numbers 1.0, 0.9, 0.8, 0.7, 0.6, 0.5, 0.4, 0.3, 0.2, 0.1, 0.05, 0.01 and 0.0.

It may be that the titanium alloy comprises no more than 2.0 wt. % tantalum (Ta) and may comprise tantalum by weight no more than 1.9, 1.8, 1.7, 1.6, 1.5, 1.4, 1.3, 1.2, 1.1, 1.0, 0.9, 0.8, 0.7, 0.6, 0.5, 0.4, 0.3, 0.2, 0.1, 0.05 or 0.01%. The alloy may comprise tantalum in a weight percent range defined between any two of the numbers 2.0, 1.9, 1.8, 1.7, 1.6, 1.5, 1.4, 1.3, 1.2, 1.1, 1.0, 0.9, 0.8, 0.7, 0.6, 0.5, 0.4, 0.3, 0.2, 0.1, 0.05, 0.01 and 0.0

It may be that the titanium alloy comprises no more than 2.0 wt. % niobium (Nb) and may comprise niobium by weight no more than 1.9, 1.8, 1.7, 1.6, 1.5, 1.4, 1.3, 1.2, 1.1, 1.0, 0.9, 0.8, 0.7, 0.6, 0.5, 0.4, 0.3, 0.2, 0.1, 0.05 or 0.01%. The alloy may comprise niobium in a weight percent range defined between any two of the numbers 2.0, 1.9, 1.8, 1.7, 1.6, 1.5, 1.4, 1.3, 1.2, 1.1, 1.0, 0.9, 0.8, 0.7, 0.6, 0.5, 0.4, 0.3, 0.2, 0.1, 0.05, 0.01 and 0.0

It may be that the titanium alloy comprises no more than 0.20 wt. % cerium (Ce) and may comprise cerium by weight no more than 0.15, 0.1, 0.09, 0.08, 0.07, 0.06, 0.05, 0.04, 0.03, 0.02, 0.01, 0.005 or 0.001%. The alloy may comprise cerium in a weight percent range defined between any two of the numbers 0.2, 0.15, 0.1, 0.09, 0.08, 0.07, 0.06, 0.05, 0.04, 0.03, 0.02, 0.01, 0.005, 0.001 and 0.0.

It may be that the present titanium alloy may include a total amount of any single element other than titanium, aluminum, zirconium, vanadium, molybdenum, iron, oxygen, nitrogen, carbon, hydrogen, palladium and ruthenium (or any subset of said elements) in an amount which by weight is no more than 1.0, 0.9, 0.8, 0.7, 0.6, 0.5, 0.4, 0.3, 0.2, 0.1, 0.05, 0.04, 0.03, 0.03, 0.02 or 0.01%. It may also be that the present titanium alloy may include a total amount of any element listed on the periodic table other than those elements specifically addressed herein in an amount which by weight is no more than 1.0, 0.9, 0.8, 0.7, 0.6, 0.5, 0.4, 0.3, 0.2, 0.1, 0.05, 0.04, 0.03, 0.03, 0.02 or 0.01%.

It may also be that the present titanium alloy may include a total amount of a combination of all elements in the alloy other than titanium, aluminum, zirconium, vanadium, molybdenum, iron, oxygen, nitrogen, carbon, hydrogen, palladium and ruthenium (or any subset of said elements) in an amount which by weight is no more than 1.0, 0.9, 0.8, 0.7, 0.6, 0.5, 0.4, 0.3, 0.2, 0.1, 0.05, 0.04, 0.03, 0.03, 0.02 or 0.01%. It may also be that the present titanium alloy may include a total amount of a combination of all elements in the alloy listed on the periodic table of elements other than those elements specifically addressed herein in an amount which by weight is no more than 1.0, 0.9, 0.8, 0.7, 0.6, 0.5, 0.4, 0.3, 0.2, 0.1, 0.05, 0.04, 0.03, 0.03, 0.02 or 0.01%. The periodic table of elements is incorporated herein by reference for the sake of brevity, as if each element thereof were listed specifically by name herein.

Embodiments of the present alloy (which may be designated in various places in this application as "Ti Alloy X") may be a heat-treatable alpha-beta titanium alloy which provides a higher strength, highly corrosion and fracture resistant, and fusion-weldable titanium alloy suitable for HPHT/XHPHT energy extraction service. The composition of one sample embodiment of Ti Alloy X is shown in Table 2 although the composition is more broadly described above. Ti Alloy X may have the basic properties listed in Table 3 and meet the specific performance criteria listed in Table 4, which reflect various desirable alloy attributes with respect to various uses related to energy extraction.

In terms of alpha-beta alloying elemental balance, Ti Alloy X may be richer in beta content (for higher strength), but leaner in alpha content (for improved $K_{SCC}$) than standard grade Ti-6Al-4V as illustrated in FIG. 2. The present alloy composition may also exhibit minimal tendency for elemental micro- and macro-segregation during vacuum melting, permitting production of very large, relatively homogeneous ingots often used in making components for the energy extraction arena.

Embodiments of the present titanium alloy may be a two-phase, alpha-beta type titanium alloy which offers microstructural options (such as the beta-transformed condition) to optimize fracture toughness, which may be desirable to provide fracture resistance useful in certain energy extraction applications.

Embodiments of the present alloy may have a certain aluminum equivalency and molybdenum equivalency. Aluminum equivalency (Al Equiv.) represents the net alpha stabilizing element potency in a titanium alloy according to Equation (1).

$$\text{Al Equiv.}=1(\text{wt. \% Al})+0.33(\text{wt. \% Sn})+0.17(\text{wt. \% Zr})+10(\text{wt. \% } O_2) \quad (1)$$

Molybdenum equivalency (Mo Equiv.) represents the "beta equivalency", or the net potency of beta phase stabilizing elements in the alloy according to Equation (2).

$$\text{Mo Equiv.}=1(\text{wt. \% Mo})+0.67(\text{wt. \% V})+2.5(\text{wt. \% Fe}) \quad (2)$$

Equation (1) may also be stated as the aluminum equivalency=aluminum weight % in the alloy+(0.33)(tin weight % in the alloy)+(0.17)(zirconium weight % in the alloy)+(10.0)(oxygen weight % in the alloy). Equation (2) may also be stated as the molybdenum equivalency=molybdenum weight % in the alloy+(0.67)(vanadium weight % in the alloy)+(2.5)(iron weight % in the alloy). Embodiments of the present alloy may have an aluminum equivalency which may be no less than 7.5 and which may be at least 6.5, and a molybdenum equivalency which may be no more than 5.9 or 6.0 and which may be at least 5.0.

Embodiments of the present titanium alloy may have total hot acidic chloride brine corrosion resistance to at least 550° F. and be fully resistant to crevice corrosion up to 550° F. in aerated or deaerated, and sweet or sour brines (wrought and weld metal). Generally, the present alloy may provide good weldability using fusion welding methods, possessing sufficient welded joint ductility and damage-tolerance in the as-welded condition, and providing a useful balance in weld metal engineering properties after PWHT.

In some embodiments, the present alloy may have a density at room temperature of no more than 0.165 lb/in$^3$; an elastic modulus at room temperature of no more than 17.0 million psi; a yield strength at room temperature which is at least 125, 130, 135, 140 or 145 ksi and which may be in a range of 125 or 130 to 145 or 150 ksi; a yield strength at a temperature of 500° F. which is at least 90, 95, 100 or 105 ksi and which may be in a range of 90 or 95 to 105 or 110 ksi; and a corrosion rate in boiling 2.0 wt. % HCl of no more than 20 mpy.

In some embodiments, the present alloy may have no local crevice attack after the alloy has been submerged for 60, 70, 80 or 90 days in naturally-aerated seawater which has a pH of 3 and is maintained at a temperature of about 500° F. or 550° F. throughout the 60, 70, 80 or 90 days.

In some embodiments, the present alloy may have a fracture toughness at room temperature in air and saltwater or seawater of at least 50, 55 or 60 ksi and in some embodiments, an after post-weld heat treatment weld of the present alloy may have a fracture toughness at room temperature in air of at least 50 or 55 ksi $\sqrt{\text{in}}$. The fracture toughness may be determined in accordance with ASTM E399-12 (Standard Test Method for Linear-Elastic Plane-Strain Fracture Toughness Klc of Metallic Materials) and ASTM E1820-13 (Standard Test Method for Measurement of Fracture Toughness).

In some embodiments, an as-welded weld (i.e, no subsequent heat treatment of the weld) of the present alloy may have an elongation at room temperature in air of at least 2.0% and an after post-weld heat treatment weld of the present alloy may have an elongation at room temperature in air of at least 4.0%.

Tests

Various tests were performed on the present alloy and other titanium alloys. For that purpose, a matrix of twenty-one small (250 gram) plasma button heats and subsequently seventeen 60 and 120 lb. double-VAR ingot heats of Ti—Al—V—(Sn and/or Zr)-(with & without Mo)—(Ru or Pd) content were prepared for evaluation. The nominal compositions and respective Al— and Mo— Equivalencies for these alloy variant heats are provided in Tables 5 and 6. These plasma-button and VAR ingot heats are herein subcategorized into the following five alloy series:

| | |
|---|---|
| Ti—Al—V—Sn—(Ru) | Series #1: |
| Ti—Al—V—Sn—Mo—(Ru) | Series #2: |
| Ti—Al—V—Zr—(Pd) | Series #3: |
| Ti—Al—V—Zr—Mo—(Pd or Ru) | Series #4: |
| Ti—Al—V—Zr—Sn—Mo—(Ru) | Series #5: |

The 250 gram button heats were beta plus alpha/beta hot rolled down to 0.11 inch thick sheet, and beta-annealed and final alpha/beta annealed (1400° F.-2 Hr-Slow Cool) to provide alloy sheet in the fully transformed-beta plus solution-treated+semi-aged (STA) condition for testing. The double-VAR ingots were beta plus alpha/beta forged to 1.25 inch slab, and subsequently alpha/beta hot rolled to 0.25-1.0 inch plate panels for heat treatment and testing. Plate heat treatment typically consisted of three steps:

1. Beta anneal (BA) at 1800° F. for 20 minutes, then air-cool (AC cooling rate ~13° F./sec) or slower cool in air between two 0.5 inch steel plates (SC cooling rate ~1.8° F./sec).
2. Intermediate alpha/beta anneal (i.e., solution-treat at 1300-1600° F.) for 1-4 hours, then cooled in air (AC cooling rate ~12° F./sec) or slower cooled (SC) in air between two 0.5 inch steel plates (SC cooling rate ~1.2° F./sec).
3. Final age at 1000° F. for 4-12 hours, then air-cool (AC).

All wrought sheet and plate materials were properly surface conditioned after final heat treatment, and chemically analyzed to verify nominal compositional aims.

Sheet and Plate Welds.

Some of the 0.11" sheet panels and 0.375" plate pieces produced were machine-GTA welded to permit weld metal and welded joint property evaluation. The sheet panels were full-penetration welds applied to both faces of the panel. The post-weld heat treatment (PWHT) applied was at 1400° F. for 2 hours and then slower cool (SC) in air between two 0.5 inch steel plates. The plate welds were multipass butt welds produced by a machine-GTA setup in which thin metal strips of filler metal were continuously hand-fed into the joint. A total of four passes filled up the 0.375 inch plate weld joint. These butt-welded panels were subsequently post-weld heat treated at 1400° or 1450° F. for 1.5 hours, slow cooled down to 1000° F., and then aged at 1000° F.~4 hours-AC for weld metal testing.

Specific Testing.

The mechanical and corrosion tests listed below were conducted:

| | Sheet | | Plate | |
|---|---|---|---|---|
| | Wrought | Welds | Wrought | Welds |
| Microstructure Characterization | X | | X | X |
| Tensile Tests at RT | X | X | X | X |
| [per ASTM E8 Spec] at 500° F. | X | | X | |
| Fracture Toughness at RT in Air ($K_Q$, $K_J$) | | | X | X |
| [per ASTM E399 at RT in Seawater ($K_{SCC}$) and E1820 Spec] | | | X | |
| Corrosion Rate in Boiling 1-3 wt. % HCl (24 hour weight-loss test) | X | X | X | X |
| Nat. Aerated Seawater at pH3 Crevice Corrosion Test (PTFE sheet-to-metal, 60-90 days) at 500 and 550° F. | X | | X | |
| Slow Strain Rate SCC Testing in Sour NaCl-rich Brine at 500 and 550° F. [4 × $10^{-6}$/sec strain rate] | | | X | |

The boiling dilute HCl corrosion rate testing listed represents a method for assessing relative titanium alloy resistance to both crevice and stress corrosion in hot aqueous chloride media. The dilute HCl corrosion rate criteria was empirically derived and correlates with known titanium alloy hot brine resistance performance.

Property Test Findings

All five series alloys were tested as to the alloy properties specified in Table 4.

Microstructure:

These fully transformed-beta microstructures were primarily fine platelet basket-weave for the BA-AC+STA condition, and a mixed basket-weave+colony structures for the slower-cooled BA-SC+STA condition. Addition of ≥1.2% Mo reduced GBA and platelet sizes, and increased the volume fraction of basket-weave structure in the BA-SC (beta anneal+slow cool) condition, thereby increasing alloy strength with minor reduction in fracture toughness.

Yield Strength.

a. Sheet: All alloy variants met the 130 ksi min. YS and 145 ksi min. UTS aims, showing minimal differences in Series #1-4 alloys. This stems from relatively high sheet air cooling rates achieved from ST anneal enhancing the aging to higher strength.

b. Sheet: $YS_{RT}/YS_{500°\ F.}$ was about 0.78 and $UTS_{RT}/UTS_{500°\ F.}$ was about 0.82 for all series, thereby meeting minimum hot strength aims.

c. Plate: Per tensile properties at room temperature listed in Table 7 and yield strength values graphically compared in FIG. 2, the following key observation was made:

Only the Series #4 and #5 alloys met the 130 ksi minimum YS criteria in all three final heat-treatment conditions (BA-AC and BA-SC plus age) plotted in FIG. 2. Although the other Series (#1-3) met minimum YS in the BA-AC+1400° F.-AC+Age and the BA-SC+1400° F.-AC+Age conditions (i.e., when air-cooled at >8 deg F./sec from the 1400° F. ST anneal), the slower cooled BA-SC+1400° F.-SC+Age condition in Series #1-3 plate did not achieve this yield strength aim. This implies that the Series #4 compositions might be somewhat more deep-hardenable than the other series alloys, which would be needed to achieve minimum strengths in heavier section components.

d. Plate: Increasing beta alloy content (i.e., Mo Equiv.) most dramatically increased strength. A moly equivalency of >5.0 met minimum strength (2A, 3A). However, a Mo equivalency ≥5.9 or 6.0 produced elevated strengths with much lower ductility after faster-cooled BA-AC+STA treatments (4D, 4F), from which it can be inferred that low unacceptable ductility and toughness can be expected in weidments where rapid cooling of each weld pass typically occurs.

e. Plate: Aluminum content >5.2 wt. % met min. YS strength aim (1A vs. 1B, 2A vs. 2C, 4B vs. 4C, 4G, 4H, 4J, 4K, 4N).

f. Plate: Increasing Zr content from 3.7% to 4.5% measurably increased strength (3C vs. 3B), and provided superior strength over equivalent (2:1, Zr:Sn) Sn content (4C vs. 2C, 3C vs. 2C) or equivalent Sn/Zr combination (4E vs. 5A).

g. Plate: Although 0.7% Mo had little effect on strength, Mo content ≥1.2% measurably increased strength (3C, 4A vs. 4C, 4G, 4E, 4K, 4N, 4O).

h. Plate: Adding 0.7-2.0% Mo additions significantly improved elongation in Series #2 alloy (2B vs. 1B).

i. Plate: $YS_{RT}/YS_{500°\ F.}$ was about 0.72 and $UTS_{RT}/UTS_{500°\ F.}$ was about 0.81 for all series, showing little effect of Zr, Sn, or Mo variations. As such, hot strength aims were met when VS minimums of ≥130 ksi were achieved.

Ductility.

Plate:

Ductility exceeded the 6% minimum elongation aim in all series alloys and heat-treatment conditions where VS was below about 145 ksi. Compared to Series #2 alloys, Series #4 alloys were more readily heat-treatable to a lower, but desirable strength window and with higher ductility after BA-AC (air-cool)+STA treatments (4C vs. 2C).

Fracture Toughness.

Plate in the fully transformed-beta plus solution-treated and aged (STA) condition (BA-SC+STA or BA-AC+STA) as plotted versus strength in FIG. 2 as conducted in room temperature air and naturally-aerated seawater:

a. As indicated in FIG. 3, all five series alloy variants generally met the 60 ksi √in minimum K value aim in air and seawater at room temperature up to a yield strength of approximately 140 ksi.

b. Series #4 (Zr—Mo containing) alloys appeared to possess somewhat higher K values in air and seawater than the Series #1-3 alloys at similar strength levels.

c. Minimum K in seawater ($K_{SCC}$) was not met when Al Equivalency was ≥7.5 [i.e., unacceptably high chloride SCC susceptibility] (2D).

d. Minimum $K_{SCC}$ in seawater was not met at Mo Equivalency ≥5.9 or 6.0 when yield strength exceeded 135 ksi (4D). Increasing Mo Equivalency ≥5.9 or 6.0 aggravated SCC susceptibility (4D, 4F), and promoted lower toughness, intergranular fracture mode.

e. $K_{SCC}$ was relatively unaffected by Mo content <1.7%, but was degraded somewhat at 1.7% Mo (2D, 4E).

f. Mo content ≥0.7% in Series #4 alloys increased proportion of intergranular vs. transgranular fracture mode in air and seawater, tending to decrease fracture toughness. This effect was mitigated to some extent by increased age times (4→12 hours) in many cases.

g. A similar minor degree of chloride SCC susceptibility was indicated for all five series alloy variants, such that the $K_{SCC(seawater)}/K_{air}$ ratio fell within the 0.8-1.0 range (typically 0.87) at yield strengths ≤142 ksi.

Corrosion Rate in Boiling Dilute HCl Solutions.

Sheet.

Utilizing a maximum allowable corrosion rate of 20 mils or milli-inches per year (mpy) in boiling 2% HCl, the following observations were derived from the Series #1-5 plasma button heat sheet coupon corrosion rates for said conditions, which are plotted in FIG. 4:

a. Acceptable Alloy Variants:
   Series #3 and 4 with Pd
   Series #1, 3, and 4 with Ru
   Series #2 with Ru, only when Mo≤0.5%
   Series #5 with Ru, but without Mo
b. Unacceptable Alloy Variants:
   Series #1 and 2 with Pd
   Series #2 with Ru, when Mo≥0.0%
c. Lowest corrosion rates were achieved with Pd-containing Series #3 and 4 alloys, exhibiting rates similar to ASTM Grades 24 (23P) and 29 Ti (Ti-29).
d. Unacceptable, elevated corrosion rates occur when Sn≥0.5% and Pd co-exist in titanium alloys.
e. Increasing Mo content tends to counteract this highly deleterious, corrosion-aggravating Sn+Pd interaction. However, Mo levels much greater than 1.2% would be needed to meet the ≤20 mpy aim.
f. When Mo was absent, Series #1 alloys with Ru had somewhat lower rates than Series #3 alloys with Ru.
g. Increasing Mo content tended to increase rates in either Series #2 (Sn—Mo) with Ru, or the Series #4 (Zr—Mo) with Ru alloys.
h. Increasing Mo content up to 1.2% has no significant effect on rates in Series #4 (Zr—Mo) with Pd alloys.

Plate.

Based on these sheet coupon results, the subsequent Series #1-5 double-VAR heat plate compositions (Table 6) were designed to avoid the highly deleterious Sn+Pd combination. Corresponding corrosion rates for all series alloy plate coupons are graphically compared in FIG. 5, revealing the following findings relative to the ≤20 mpy aim:

a. Acceptable Alloy Variants:
   Series #3 and 4 with Pd
   Series #1 and 4 with Ru
b. Unacceptable Alloy Variants:
   Series #2 with Ru
   Series #4 with Ru at Mo equivalency >5.9 (4D)
   Series #5 with Ru when Mo≥1.7% (5A)
c. As with sheet, lowest corrosion rates were achieved with Pd-containing Series #3 and 4 alloys exhibiting rates similar to Grade 29 Ti.
d. Increasing Mo content up to 1.7% had little effect on rates for Series #4 with Pd alloys.
e. Series #1-4 alloy corrosion rates were not significantly affected by final heat-treatment variations such as BA-SC vs. BA-AC, or by subsequent STA final heat-treat parameter changes.

Plate Weld Metal.

Similar boiling 2 wt. % HCl corrosion rate testing was conducted on the post-weld heat-treated plate welds, with results compared to corresponding base metal in FIG. 5. The following observations were derived:

a. Weld metal corrosion rates paralleled plate base metal trends, but tended to be several mpy higher than corresponding base metal in most cases. As such, the Series #3 and #4 with Pd welds consistently exhibited the lowest rates and were just slightly higher than the Grade 29 Ti weld.
b. Two exceptions included Series #1 with Ru (1A) alloy where the weld exhibited over twice the rate of base metal, and Series #4 with Ru (4D) which showed a finite drop in weld corrosion rate relative to its base.

Crevice Corrosion Resistance.

High temperature 60-day crevice tests in naturally-aerated pH3 seawater were conducted on plate Series #1-4 alloy variants containing Ru, and Series #3 and 4 alloys containing Pd. All of these 500° F. crevice test coupons revealed no significant metal loss or localized attack on creviced or uncreviced surfaces. Subsequent 60-day crevice testing in pH3 seawater at 550° F. on plasma button heat sheets of Series #4 alloys with Ru or Pd revealed that localized crevice attack was prevented for alloys with ≥0.04 wt. % Ru or ≥0.03 wt. % Pd.

Hot Sour Brine Stress Corrosion Cracking (SCC) Resistance.

Series #1-4 alloy plates were tested in accordance with NACE TM 0198-2011 (Slow Strain Rate Test Method for Screening Corrosion-Resistant Alloys for Stress Corrosion Cracking in Sour Oilfield Service) for SCC susceptibility in high temperature, acidic, deaerated 25-33% NaCl brines pressurized with $H_2S$ and $CO_2$ gases (and containing elemental sulfur) as detailed in Table 8. This table lists the reduction in area (RA) and time-to-failure (TTF) environmental-to-inert reference ratios for each alloy, which indicate degree of SCC susceptibility after slow straining (at $4\times10^{-6}$/sec) round/smooth tensile specimens to failure. Although most Series #1-4 met the ≥0.90 ratio aim, specimen fracture examination revealed significant evidence of brittle fracture areas due to chloride SCC on all Series #1, 2, and 3 alloy specimens. No significant indications of SCC (i.e., all ratios ≥0.90 and no brittle fracture area) were noted on all Series #4 alloys with Pd (4A-4E, 4G) or Ru (4D and 4N) except for the 4F alloy with its elevated Mo equivalency of 7.0. These Series #4 alloys met the 550° F. hot sour brine SCC resistance requirement, unlike the NACE Sour Standard-approved Ti-6246 alloy tested for comparison.

Thus, the present alloy (or plates or other components thereof) meet these SCC resistance requirements (or are fully SCC resistant) in hot deaerated 25-33% NaCl brine at a temperature of at least 160° F., 170° F., 200° F., 300° F., 400° F., 500° F., 550° F. or more after submersion of the alloy/component in the hot brine. Under these conditions, the present alloy may have no significant indications of SCC, such that the RA ratio and the TTF ratio are at least 0.90 and the alloy exhibits either no brittle fracture area or the brittle fracture area is no more than 1.0 or 2.0% of the total surface area of the alloy exposed to the hot brine. As shown in Table 8, various of the alloys were tested in a hot brine of deaerated 25% sodium chloride (NaCl) with 250 pounds per square inch absolute (psia) $H_2S$, 250 psia $CO_2$, 0.5% acetic acid (HAc) and 1 gram per liter (gpl) sulfur (S); or in a hot brine of deaerated 33% NaCl, 145 psia $H_2S$, 1000 psia $CO_2$ and 1 gpl S; or in a hot brine of deaerated 33% NaCl, with 500 psia $H_2S$, 500 psia $CO_2$ and 1 gpl S.

Weldability.

Weldability assessment normally includes consideration of weld metal properties and robustness in both as-welded and post-weld heat-treated (PWHT) conditions. As such, a multi-pass fusion butt-welded component must possess adequate ductility, toughness, and damage tolerance to handle welded joint grinding, machining, handling, etc., before and after PWHT. After PWHT, the component weld metal and heat-affected-zone (HAZ) metal should meet and preferably exceed the minimum yield strength of corresponding Ti Alloy X wrought/base metal, while comfortably meeting the minimum ductility and fracture toughness ($K_J$) aims listed in Table 4.

Plate Weld Mechanical Properties.

Figure 6:
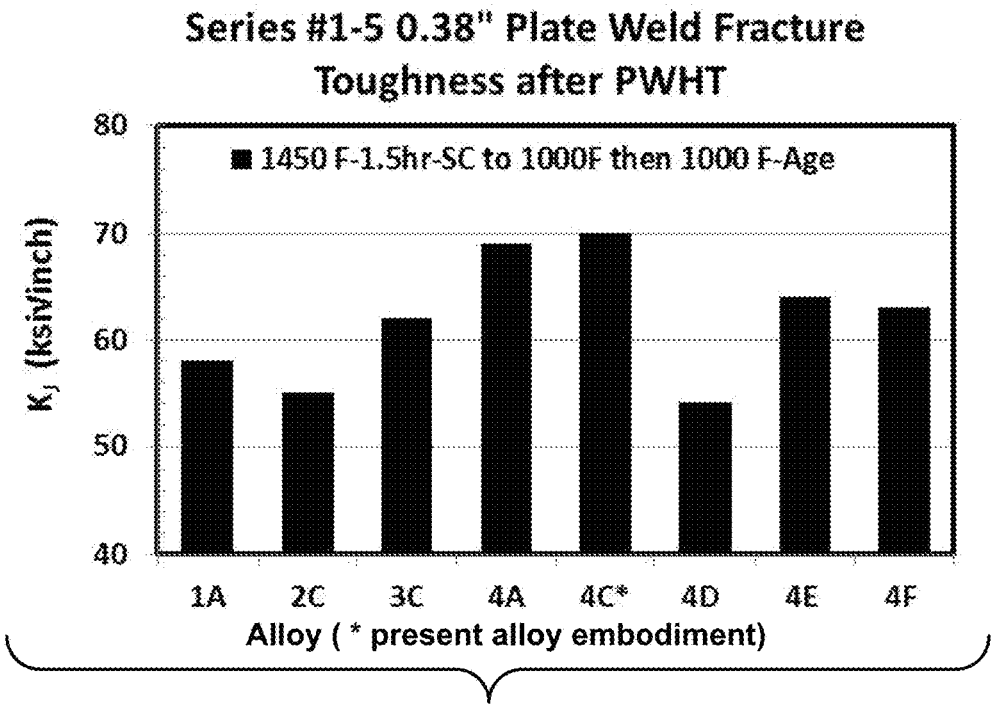
FIG. 6 is a graph showing series #1-4 alloy plate weld metal fracture toughness after post-weld heat treatment.

The all-weld tensile and fracture toughness properties of multi-pass machine GTA-welded 0.375" plate pieces after PWHT were determined for most Series #1-4 alloy variants. After a PWHT of either 1400° F. or 1450° F. plus Age, all four series produced welds exhibiting 136-150 ksi YS and elongations ≥4%. Table 9 provides some typical non-limiting examples of Series #2 vs. #4 weld metal properties after PWHT, which confirm these tensile properties. However, closer inspection of the ductility values revealed measurably higher elongation and particularly percent reduction in area (% RA) values for the Series #4 welds compared to the Sn-bearing Series #1 and #2 welds. A similar comparison was noted for weld $K_J$ fracture toughness values, which were consistently higher for Series #4 welds (except for 4D) compared to Series #1 and #2 welds (see Table 9 and FIG. 6). The other Zr-bearing Series #3 welds also displayed good ductility and elevated K values above the minimum 60 ksi √in desired criteria.

Tensile testing of Series #1-4 weld metal in the as-welded condition revealed variable and low (<2%) elongation and % RA values in the Sn-bearing Series #1 and 2 alloys. On the other hand, both Series #3 and 4 alloy welds consistently met the ≥2% elongation and % RA requirement. As such, the Zr-bearing Series #3 and 4 welds displayed a more desirable combination of moderate strength and improved ductility and toughness over Sn-bearing Series #1 and 2 alloy welds in both the as-welded and PWHT'd conditions.

Corrosion Resistance (in Hot Acidic Chloride Brines).

The dilute boiling HCl test revealed a previously unknown, unexpected, but very serious incompatibility between Sn and Pd alloy constituents in regards to achieving adequate alloy reducing acid resistance. This incompatibility may be addressed in the present alloy by keeping the amount of Sn in the alloy relatively low when the alloy contains Pd in the amounts discussed above.

Non-Limiting Examples of Ti Alloy X Properties.

Various non-limiting examples of tensile and fracture properties achievable in Ti Alloy X in several wrought product forms are provided in Table 11. The tensile properties listed in Table 11 demonstrate that a 125 ksi or 130 ksi minimum room temperature yield strength may be achieved for products in the beta-transformed condition, depending on plate or pipe cross-section and final heat-treatment (STA). Corresponding hot yield strength values at 500° F. also meet the 90 ksi minimum goal. Alpha-beta processed (plus STA) products, such as the plate listed, are capable of substantially higher strengths combined with good ductility (Table 11), but having somewhat lower fracture toughness in air.

Table 12 demonstrates that elevated fracture toughness ($K_Q$, $K_{SCC}$) are consistently achieved in these beta-transformed (plus STA) plate and pipe product forms. Note that both $K_{air}$ and saltwater $K_{SCC}$ values exceed the 60 ksi √in minimum aim, and exhibit saltwater K degradation (knock-down) of less than 15%.

Figure 7:
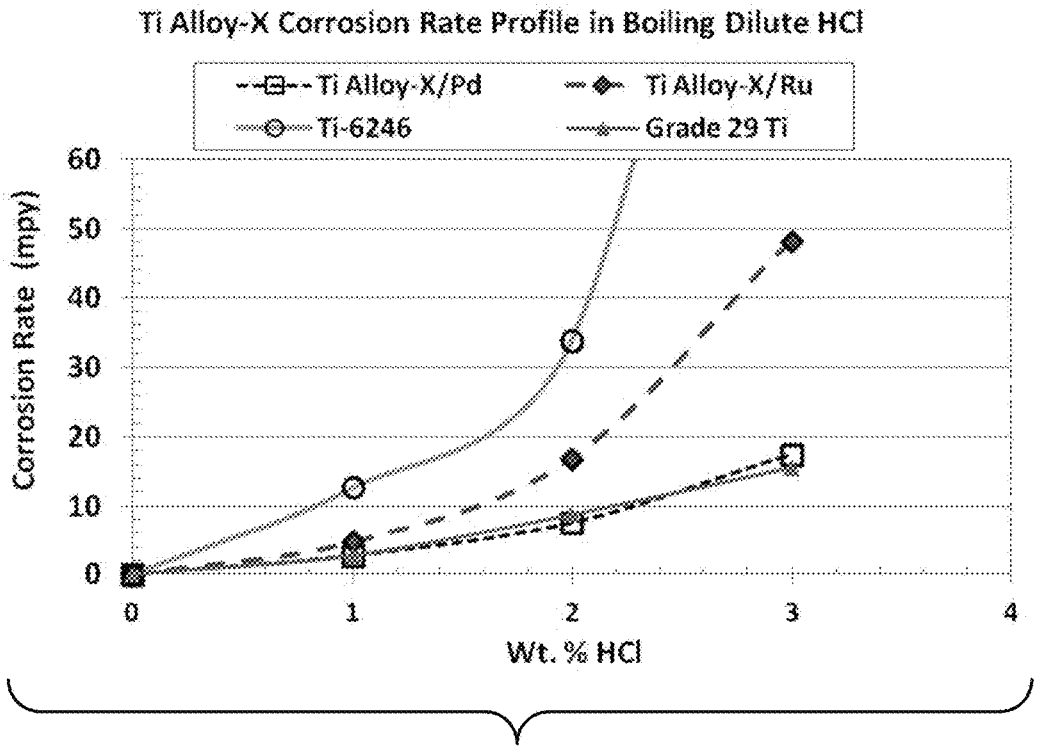
FIG. 7 is a graph showing comparative corrosion rate profiles for Ti Alloy X —Pd and —Ru versus Grade 29 titanium and Ti-6246 in boiling dilute HCl solutions.

Confirmation of the superior hot reducing acid chloride resistance of Ti alloy X (with either —Pd or —Ru addition) is illustrated in the corrosion rate profile plotted in FIG. 7. The Pd— alloy version possesses similar acid resistance to the Grade 29 Ti alloy, whereas the Ru— alloy version is slightly less resistant, but still substantially exceeds that of the Ti-6246 alloy. This comparative alloy corrosion resistance in hot dilute HCl directly correlates with the alloy's resistance to crevice and stress corrosion (SCC) resistance in hot aqueous chloride media.

TABLE 1

Comparison of Higher-Strength Commercial Alpha-Beta* and Beta** Titanium Alloys

| Ti Alloy (Designations) [Common Name] | Minimum Yield Strength [ksi] | Positive Features | Negative Traits/Limitations |
|---|---|---|---|
| Ti—6Al—4V* (ASTM Gr. 5 UNS R56400) [Ti-64] | 120 min. | Lowest cost/most commercially available<br>Fully weldable | Only medium strength and possible creep limitations<br>Poor stress corrosion resistance in aqueous chloride media<br>Aqueous chloride resistance limited to <180° F. |
| Ti—6Al—4V ELI* (ASTM Gr. 23 UNS R56407) [Ti-64 ELI] | 110 min. | Lower cost<br>Fully weldable<br>High air and brine toughness | Only medium strength<br>Hot strength and possible creep limitations<br>Aqueous chloride resistance limited to <180° F. |
| Ti—6Al—4V—0.1Ru* (ASTM Gr. 29 UNS R56404) [Ti-64-Ru] | 110 min. | Resistant to brines up to 600° F.<br>Approved for sour service per NACE MR0175/ISO Standard<br>Fully weldable<br>High air and brine touhness | Only medium strength<br>Hot strength and possible creep limitations |
| Ti—6Al—6V—2Sn* (UNS R56620) [Ti-662] | 130-140 min. | Medium-high strength<br>Lower cost | Limited fusion weldability<br>Very poor localized and stress corrosion resistance in aqueous chlorides |
| Ti—6Al—2Sn—2Zr—2Mo—2Cr—0.15Si* [Ti-6-22-22] | 135-160 min. | High strength capability<br>Good toughness in air | Not fusion weldable<br>Limited resistance to localized attack in hot brines<br>Poor stress corrosion resistance in aqueous chlorides |

TABLE 1-continued

Comparison of Higher-Strength Commercial Alpha-Beta* and Beta** Titanium Alloys

| Ti Alloy (Designations) [Common Name] | Minimum Yield Strength [ksi] | Positive Features | Negative Traits/Limitations |
|---|---|---|---|
| Ti—6Al—2Sn—4Zr—6Mo* (R56260) [Ti-6246] | 135-160 min. | High strength capability<br>Approved for sour service per NACE MR0175/ISO Standard | Not fusion weldable<br>Low toughness in air and aqueous chloride media<br>Brine resistance limited to 450°-500° F. |
| Ti—3Al—8V—6Cr—4Zr—4Mo** (ASTM Gr. 19 R58640) [Ti-38644] | 160 min. | Elevated strength<br>Low elastic modulus<br>Approved for sour service per NACE MR0175/ISO Standard | High cost<br>Limited fusion weldability<br>Aqueous chloride media resistance limited to ~400° F.<br>Poor machinability<br>Higher density<br>Only moderate fracture toughness |

TABLE 2

Sample Titanium Alloy-X Composition
Ti—5.6Al—4.3Zr—5.7V—1.3Mo—0.15Fe—0.10O—(0.06Pd or 0.09Ru)

| Element | Sample |
|---|---|
| Al | 5.5 (wt. %) |
| Zr | 4.25 |
| V | 5.7 |
| Mo | 1.25 |
| Fe | 0.15 |
| O | 0.10 |
| N | 0.05 max |
| C | 0.03 max |
| H | 0.015 max |
| Pd or (Ru) | 0.06 (0.09) |
| Ti | Balance |

TABLE 3

Ti Alloy X Properties in STA Condition

Density 0.164 lb/in$^3$
Beta Transus Approx. 1700° F.
Elastic Modulus ~16.5 million psi
Min. 0.2% YS at RT
(dependent on section-size and cooling rate)
135 ksi (below 0.7 inch wall)
130 ksi (below 1.5 inch wall)
125 ksi (above 1.5 inch wall)

TABLE 4

Ti Alloy-X Properties Related to Expanded Energy Service

| Alloy Property | Conditions/Environment | Value |
|---|---|---|
| 0.2% Yield Strength | at room temp.<br>at 500° F. | 125-150 ksi*<br>90-110 ksi* |
| Corrosion Resistance | | |
| a) Corrosion rate | Boiling 2 wt. % HCl (after 24 hours) | 20 mpy max. |
| b) Crevice corrosion | Naturally-aerated seawater pH 3 at 550° F. (after 60 days) | No localized crevice attack |
| c) Sour brine stress corrosion cracking (SCC) | Slow-strain rate testing (SSRT) in 25% NaCl with ≥250 psia $H_2S$ and $CO_2$ + 1 gpl sulfur at 550° F. | SSRT sour/air ductility ratio ≥0.90, and no brittle fracture area |
| Fusion Weldability [GTA welding of plate] | Elongation at room temp. in air<br>as welded<br>after post-weld heat treatment<br>Fracture toughness ($K_J$) at room temp. in air after post-weld heat treatment | <br>2% min.<br>4% min.<br>55 ksi √in min. |
| Fracture toughness | $K_Q$ at room temp. in air and seawater | 60 ksi √in min. |
| Density | at room temp. | 0.165 lb/in$^3$ max. |
| Elastic modulus | at room temp. | 17.0 million psi max. |

*Min. YS dependent on component section thickness

TABLE 5

Ti Alloy Code for Plasma Button Heat Sheets Tested (Series #1-5)

| Alloy Code | Series # | Nominal Composition (wt. %) | Alum Equiv. | Moly Equiv. |
|---|---|---|---|---|
| 1R | 1 | Ti—5.6Al—2Sn—7.5V—0.12Ru | 7.27 | 5.40 |
| 2R | 2 | Ti—5.6Al—2Sn—6.8V—0.5Mo—0.12Ru | 7.27 | 5.43 |
| 3R | 2 | Ti—5.6Al—2Sn—5.8V—1.2Mo—0.12Ru | 7.27 | 5.46 |
| 4R | 3 | Ti—5.5Al—7.5V—4Zr—0.12Ru | 7.17 | 5.40 |
| 5R | 4 | Ti—5.6Al—4Zr—6.8V—0.5Mo—0.12Ru | 7.27 | 5.43 |
| 6R | 2 | Ti—5.2Al—2Sn—5.8V—1.2Mo—0.12Ru | 6.87 | 5.46 |
| 7R | — | Ti—5.6Al—2Sn—4.4V—1.2Mo—0.5Fe—0.09Si—0.12Ru | 7.27 | 5.40 |
| 8R | 2 | Ti—5.6Al—2Sn—6.3V—1.2Mo—0.12Ru | 7.27 | 5.80 |
| 9R | 2 | Ti—5.3Al—1.6Sn—5.1V—1Mo—0.12Ru | 6.83 | 4.79 |
| 10R | 3 | Ti—5Al—10Zr—7.5V—0.12Ru | 7.67 | 5.40 |
| 11R | 5 | Ti—5.6Al—1Sn—2Zr—7.5V—0.09Si—0.12Ru | 7.27 | 5.40 |
| 12R | 5 | Ti—5.6Al—1Sn—2Zr—7.5V—0.12Ru | 7.27 | 5.40 |

TABLE 5-continued

Ti Alloy Code for Plasma Button Heat Sheets Tested (Series #1-5)

| Alloy Code | Series # | Nominal Composition (wt. %) | Alum Equiv. | Moly Equiv. |
|---|---|---|---|---|
| 20R | 1 | Ti—5.6Al—2Sn—7.5V—0.09Si—0.12Ru | 7.27 | 5.40 |
| 1P | 1 | Ti—5.6Al—2Sn—7.5V—0.06Pd | 7.27 | 5.40 |
| 2P | 2 | Ti—5.6Al—2Sn—6.8V—0.5Mo—0.06Pd | 7.27 | 5.43 |
| 3P | 2 | Ti—5.6Al—2Sn—5.8V—1.2Mo—0.06Pd | 7.27 | 5.46 |
| 4P | 3 | Ti—5.6Al—4Zr—7.5V—0.06Pd | 7.27 | 5.40 |
| 5P | 4 | Ti—5.6Al—4Zr—6.8V—0.5Mo—0.06Pd | 7.27 | 5.43 |
| 16P | 4 | Ti—5.5Al—4Zr—6.3V—0.5Mo—0.06Pd | 7.17 | 5.10 |
| 17P* | 4 | Ti—5.6Al—4Zr—5.8V—1.2Mo—0.06Pd | 7.27 | 5.46 |
| 23P | — | Ti—6Al—4V—0.06Pd | 7.10 | 3.06 |
| Ti—29 | — | Ti—6Al—4V—0.12Ru (ASTM Grade 29) | 7.10 | 3.06 |

*Embodiment of Present Alloy

TABLE 6

Legend for Double-VAR Heat Ti Alloy Series #1-5 Plate Compositions Investigated

| Alloy Code | Nom. Composition | Aluminum Equiv. | Moly Equiv. | Beta Transus |
|---|---|---|---|---|
| | Series #1 Ti—Al—V—(Sn—Ru) | | | |
| 1A | Ti—5.2Al—2Sn—7.5V—0.12Ru | 6.87 | 5.40 | 1719° F. |
| 1B | Ti—5.6Al—2Sn—7.5V—0.12Ru | 7.27 | 5.40 | 1725° F. |
| | Series #2 Ti—Al—V—(Sn—Mo—Ru) | | | |
| 2A | Ti—5.3Al—1.6Sn—5.1V—1Mo—0.12Ru | 6.83 | 4.79 | 1742° F. |
| 2B | Ti—5.6Al—2Sn—5.8V—1.2Mo—0.12Ru | 7.27 | 5.46 | 1740° F. |
| 2C | Ti—5.6Al—2.25Sn—5.7V—1.25Mo—0.15Fe—0.10O—0.12Ru | 7.35 | 5.44 | 1721° F. |
| 2D | Ti—5.7Al—2.3Sn—5.0V—1.7Mo—0.15Fe—0.11O—0.12Ru | 7.57 | 5.43 | 1726° F. |
| | Series #3 Ti—Al—V—(Zr—Pd) | | | |
| 3A | Ti—5.5Al—3.5Zr—7.0V—0.15Fe—0.116O—0.06Pd | 7.18 | 5.07 | 1705° F. |
| 3B | Ti—5.5Al—3.7Zr—7.5V—0.15Fe—0.09O—0.06Pd | 7.02 | 5.40 | 1700° F. |
| 3C | Ti—5.5Al—4.5Zr—7.5V—0.15Fe—0.08O—0.06Pd | 7.05 | 5.40 | — |
| | Series #4 Ti—Al—V—(Zr—Mo—Pd/Ru) | | | |
| 4A | Ti—5.5Al—3.7Zr—6.5V—0.7Mo—0.15Fe—0.09O—0.06Pd | 7.02 | 5.43 | 1699° F. |
| 4B* | Ti—5.25Al—4.2Zr—5.7V—1.25Mo—0.15Fe—0.09O—0.06Pd | 6.85 | 5.44 | 1671° F. |
| 4C* | Ti—5.6Al—4.5A—5.7V—1.25Mo—0.15Fe—0.10O—0.06Pd | 7.35 | 5.44 | 1692° F. |
| 4D | Ti—5.5Al—4.5Zr—6.4V—1.25Mo—0.15Fe—0.10O—0.12Ru | 7.25 | 5.91 | 1686° F. |
| 4E | Ti—5.5Al—4.5Zr—5.0V—1.7Mo—0.15Fe—0.10O—0.06Pd | 7.25 | 5.43 | 1685° F. |
| 4F | Ti—5.5Al—4.5Zr—7.4V—1.7Mo—0.15Fe—0.10O—0.06Pd | 7.25 | 7.03 | — |
| 4G* | Ti—5.5Al—4.3Zr—5.5V—1.5Mo—0.15Fe—0.09O—0.06Pd | 7.12 | 5.56 | 1721° F. |
| 4H* | Ti—5.65Al—4.3Zr—6.0V—1.1Mo—0.15Fe—0.10O—0.06Pd | 7.37 | 5.50 | 1715° F. |
| 4J* | Ti—5.5Al—4.3Zr—5.6V—1.5Mo—0.15Fe—0.10O—0.06Pd | 7.22 | 5.63 | 1713° F. |
| 4K* | Ti—5.6Al—4.3Zr—6.0V—1.1Mo—0.15Fe—0.11O—0.06Pd | 7.42 | 5.50 | 1682° F. |
| 4N* | Ti—5.55Al—4.3Zr—5.75V—1.35Mo—0.15Fe—0.10O—0.12Ru | 7.37 | 5.58 | 1719° F. |
| 4O* | Ti—5.7Al—4.3Zr—5.6V—1.4Mo—0.16Fe—0.10O—0.07Pd | 7.41 | 5.48 | 1715° F. |
| | Series #5 Ti—Al—V—(Sn—Zr—Mo—Ru) | | | |
| 5A | Ti—5.5Al—1Sn—2.5Zr—5.0V—1.7Mo—0.15Fe—0.10O—0.12Ru | 7.25 | 5.43 | 1700° F. |

*Embodiment of Present Alloy

TABLE 7

Room Temperature Tensile Properties of Series #1-5 0.5" Plate in BA-SC and BA-AC Plus STA Conditions

| Series Alloy Code | Heat Treatment | UTS (ksi) | 0.2% YS (ksi) | Elong. (%) | RA (%) |
|---|---|---|---|---|---|
| 1A | BA-SC + 1400° F.-2 Hr-AC + 1000° F.-4 Hr-AC | 142 | 129 | 9 | 17 |
| | BA-AC + 1400° F.-2 Hr-AC + 1000° F.-4 Hr-AC | 151 | 136 | 6 | 13 |
| 1B | BA-SC + 1400° F.-2 Hr-AC + 1000° F.-4 Hr-AC | 152 | 138 | 7 | 12 |
| | BA-AC + 1400° F.-2 Hr-AC + 1000° F.-4 Hr-AC | 158 | 142 | 5 | 8 |

TABLE 7-continued

Room Temperature Tensile Properties of Series #1-5 0.5" Plate in BA-SC and BA-AC Plus STA Conditions

| Series Alloy Code | Heat Treatment | UTS (ksi) | 0.2% YS (ksi) | Elong. (%) | RA (%) |
|---|---|---|---|---|---|
| 2A | BA-SC + 1400° F.-2 Hr-AC + 1000° F. 4 Hr-AC | 147 | 131 | 10 | 20 |
| | BA-AC + 1400° F.-2 Hr-AC + 1000° F.-4 Hr-AC | 151 | 134 | 10 | 18 |
| 2B | BA-SC + 1400° F.-2 Hr-AC + 1000° F.-4 Hr-AC | 154 | 139 | 8 | 16 |
| | BA-AC + 1400° F.-2 Hr-AC + 1000° F.-4 Hr-AC | 159 | 143 | 8 | 20 |
| 2C | BA-SC + 1400° F.-2 Hr-AC + 1000° F.-12 Hr-AC | 151 | 135 | 8.3 | 18 |
| | BA-AC + 1400° F.-2 Hr-AC + 1000° F.-4 Hr-AC | 157 | 142 | 6 | 9.8 |
| | BA-SC + 1400° F.-2 Hr-SC + 1000° F.-12 Hr-AC | 146 | 129 | 11 | 15 |
| 2D | BA-SC + 1400° F.-2 Hr-AC + 1000° F.-12 Hr-AC | 152 | 136 | 11 | 20 |
| | BA-AC + 1400° F.-2 Hr-AC + 1000° F.-12 Hr-AC | 162 | 148 | 7.3 | 12 |
| 3A | BA-SC + 1400° F.-2 Hr-AC + 1000° F.-12 Hr-AC | 152 | 138 | 8.8 | 18.5 |
| | BA-AC + 1400° F.-2 Hr-AC + 1000° F.-4 Hr-AC | 151 | 136 | 9.5 | 22.5 |
| | BA-SC + 1400° F.-2 Hr-SC + 1000° F.-12 Hr-AC | 143 | 131 | 11 | 26.5 |
| 3B | BA-SC + 1400° F.-2 Hr-AC + 1000° F.-12 Hr-AC | 152 | 137 | 9.5 | 19.5 |
| | BA-AC + 1400° F.-2 Hr-AC + 1000° F.-4 Hr-AC | 153 | 138 | 9 | 21 |
| | BA-SC + 1400° F.-2 Hr-SC + 1000° F.-12 Hr-AC | 142 | 128 | 12.5 | 28 |
| 3C | BA-SC + 1400° F.-2 Hr-AC + 1000° F.-12 Hr-AC | 154 | 139 | 8.5 | 18.5 |
| | BA-AC + 1400° F.-2 Hr-AC + 1000° F.-4 Hr-AC | 154 | 140 | 8.8 | 17 |
| | BA-SC + 1400° F.-2 Hr-SC + 1000° F.-4 Hr-AC | 142 | 127 | 11 | 18.5 |
| 4A | BA-SC + 1400° F.-2 Hr-AC + 1000° F.-12 Hr-AC | 152 | 136 | 8.3 | 17 |
| | BA-AC + 1400° F.-2 Hr-AC + 1000° F.-4 Hr-AC | 152 | 137 | 9.3 | 19 |
| | BA-SC + 1400° F.-2 Hr-SC + 1000° F.-12 Hr-AC | 140 | 125 | 11 | 26.5 |
| 4B* | BA-SC + 1400° F.-2 Hr-AC + 1000° F.-12 Hr-AC | 148 | 134 | 9.8 | 19.5 |
| | BA-AC + 1400° F.-2 Hr-AC + 1000° F.-12 Hr-AC | 152 | 136 | 8.5 | 16 |
| | BA-SC + 1400° F.-2 Hr-SC + 1000° F.-12 Hr-AC | 139 | 126 | 12 | 28.5 |
| 4C* | BA-SC + 1400° F.-2 Hr-AC + 1000° F.-12 Hr-AC | 154 | 139 | 8.3 | 15.5 |
| | BA-AC + 1400° F.-2 Hr-AC + 1000° F.-4 Hr-AC | 154 | 140 | 9 | 16.5 |
| | BA-SC + 1400° F.-2 Hr-SC + 1000° F.-12 Hr-AC | 146 | 133 | 11.5 | 20 |
| 4D | BA-SC + 1400° F.-2 Hr-AC + 1000° F.-12 Hr-AC | 157 | 142 | 8.5 | 18 |
| | BA-AC + 1400° F.-2 Hr-AC + 1000° F.-12 Hr-AC | 164 | 150 | 7.5 | 13 |
| | BA-SC + 1400° F.-2 Hr-SC + 1000° F.-12 Hr-AC | 149 | 135 | 11.5 | 24 |
| 4E | BA-SC + 1400° F.-2 Hr-AC + 1000° F.-12 Hr-AC | 153 | 139 | 9.8 | 17.5 |
| | BA-AC + 1400° F.-2 Hr-AC + 1000° F.-12 Hr-AC | 158 | 143 | 8 | 11 |
| | BA-SC + 1400° F.-2 Hr-SC + 1000° F.-12 Hr-AC | 147 | 133 | 10.5 | 22 |
| 4F | BA-SC + 1400° F.-2 Hr-AC + 1000° F.-12 Hr-AC | 167 | 151 | 8 | 13.5 |
| | BA-SC + 1400° F.-2 Hr-SC + 1000° F.-12 Hr-AC | 158 | 144 | 10 | 16.5 |
| 4H* | BA-SC + 1400° F.-2 Hr-AC + 1000° F. 12 Hr-AC | 155 | 140 | 10 | 16.5 |
| | BA-AC + 1400° F.-2 Hr-AC + 1000° F.-12 Hr-AC | 157 | 143 | 8.5 | 19.5 |
| | BA-SC + 1400° F.-2 Hr-SC + 1000° F.-12 Hr-AC | 149 | 134 | 12.5 | 18 |
| 4K* | BA-SC + 1400° F.-2 Hr-AC + 1000° F.-12 Hr-AC | 157 | 141 | 9.5 | 17.5 |
| | BA-AC + 1400° F.-2 Hr-AC + 1000° F.-12 Hr-AC | 161 | 148 | 7 | 11.5 |
| | BA-SC + 1400° F.-2 Hr-SC + 1000° F.-12 Hr-AC | 148 | 133 | 11 | 25.0 |
| 4N* | BA-SC + 1400° F.-2 Hr-AC + 1000° F.-12 Hr-AC | 151 | 135 | 9 | 14 |
| | BA-AC + 1400° F.-2 Hr-AC + 1000° F.-12 Hr-AC | 155 | 140 | 7 | 14 |
| | BA-SC + 1400° F.-2 Hr-SC + 1000° F.-12 Hr-AC | 145 | 130 | 11.5 | 22.5 |
| 4O* | BA-SC + 1400° F.-2 Hr-AC + 1000° F.-12 Hr-AC | 159 | 142 | 8.5 | 17 |
| | BA-AC + 1400° F.-2 Hr-AC + 1000° F.-12 Hr-AC | 160 | 144 | 8.5 | 18 |
| | BA-SC + 1400° F.-2 Hr-SC + 1000° F.-12 Hr-AC | 147 | 132 | 10.5 | 22.5 |
| 5A | BA-SC + 1400° F.-2 Hr-AC + 1000° F.-12 Hr-AC | 150 | 134 | 11 | 23.5 |
| | BA-AC + 1400° F.-2 Hr-AC + 1000° F.-12 Hr-AC | 160 | 146 | 8 | 13 |
| | BA-SC + 1400° F.-2 Hr-SC + 1000° F.-12- Hr-AC | 146 | 131 | 11 | 22.5 |

*Embodiment of Present Alloy

TABLE 8

Series #1-4 Alloy Plate Slow Strain Rate SCC Tensile Test Results in Hot Sour Brine

| Alloy Code | Test Temp. | RA Ratio | TTF Ratio | Brittle Fracture Area (% of total) | SCC Occurrence? |
|---|---|---|---|---|---|
| (Deaerated 25% NaCl, 250 psia $H_2S$, 250 psia $CO_2$, 0.5% HAc, 1 gpl S°) | | | | | |
| 1B | 500° F. | 0.75 | 0.93 | 10-15 | Yes (TGC) |
| | 550° F. | 0.91 | 0.89 | — | Yes (TGC) |
| 2B | 500° F. | 0.83 | 1.04 | 10-15 | Yes (TGC) |
| | 550° F. | 0.83 | 0.91 | — | Yes (TGC) |
| 2D | 500° F. | 1.00 | 0.91 | ~15 | Yes (TGC) |
| | 550° F. | 0.80 | 0.86 | — | Yes (TGC) |
| 3B | 500° F. | 1.00 | 0.98 | <10 | Yes (TGC) |
| | 550° F. | 1.04 | 1.05 | 5 | Yes (TGC) |

TABLE 8-continued

Series #1-4 Alloy Plate Slow Strain Rate SCC Tensile Test Results in Hot Sour Brine

| Alloy Code | Test Temp. | RA Ratio | TTF Ratio | Brittle Fracture Area (% of total) | SCC Occurrence? |
|---|---|---|---|---|---|
| 3C | 500° F. | 0.91 | 0.95 | ~5 | Yes (TGC) |
| | 550° F. | 0.80 | 0.93 | ~10-20 | Yes (TGC) |
| 4A | 500° F. | 1.07 | 0.99 | 0 | No |
| | 550° F. | 1.10 | 0.95 | <1 | No |
| 4C* | 500° F. | 1.06 | 1.07 | 0 | No |
| | 550° F. | 0.95 | 1.09 | <2 | No |
| 4G* | 550° F. | 1.03 | 0.94 | 0 | No |
| 4D | 500° F. | 1.10 | 1.07 | 0 | No |
| 4E | 500° F. | 1.04 | 1.06 | 0 | No |
| 4F | 550° F. | 0.59 | 0.72 | ≥50 | Yes |

TABLE 8-continued

| Series #1-4 Alloy Plate Slow Strain Rate SCC Tensile Test Results in Hot Sour Brine | | | | | |
|---|---|---|---|---|---|
| Alloy Code | Test Temp. | RA Ratio | TTF Ratio | Brittle Fracture Area (% of total) | SCC Occurrence? |
| (Deaerated 33% NaCl, 145 psia $H_2S$, 1000 psia $CO_2$, 1 gpl S°) | | | | | |
| 4F | 550° F. | 0.59 | 0.61 | ≥50 | Yes (Extensive IGC) |
| 4G* | 550° F. | 0.95 | 1.02 | 0 | No |
| Ti-6246 | 550° F. | 0.65 | 0.56 | 40 | Yes (TGC) |
| (Deaerated 33% NaCl, 500 psia $H_2S$, 500 psia $CO_2$, 1 gpl S°) | | | | | |
| 4N* | 550° F. | 1.00 | 1.01 | 0 | No |

*Embodiment of Present Alloy (TGC) = transgranular stress corrosion cracking (IGC) = intergranular stress corrosion cracking TABLE 9-continued

| Comparison of Series #2 (Sn—Mo) vs. Series #4 (Zr—Mo) Alloy Plate Weld Metal Properties | | | | | |
|---|---|---|---|---|---|
| Series # (Alloy Code) | Post Weld Heat Treatment* | UTS (ksi) | YS (ksi) | % Elong. (% RA) | $K_J$ (ksi √in) |
| (4C)** | 1450° F. | 150 | 137 | 8 (19) | 70 |
| Series #4 | 1400° F. | 156 | 147 | 7 (12) | 60 |
| (4D) | 1450° F. | 153 | 141 | 9 (19) | 56 |
| Series #4 | 1400° F. | 153 | 142 | 7 (18) | 56 |
| (4E) | 1450° F. | 149 | 136 | 9 (20) | 58 |

*1400° or 1450° F. 1.5 Hr-Slow Cool + 1000° F. 4 Hr-Age

**Embodiment of Present Alloy

TABLE 10

| Ti Alloy X Compositional Boundaries Derived from Series #1-5 Test Results | | | |
|---|---|---|---|
| Alloying Element | Limits | Wt. % | Reasons/Requirement (Comments) |
| Al | Lower | 5.0 | Meet min. YS |
| | Upper | 6.0 | Max. Al Equiv. to meet min. $K_{SCC}$ (minimize Alpha 2 phase) |
| Zr | Lower | 3.75 | Meet min. YS |
| | Upper | 4.75 | Max. Al Equiv. to meet min. $K_{SCC}$ (minimize Alpha 2 phase) |
| Sn | Upper w/Pd | 0.25 | Sn addition to permit either Pd or Ru alloy addition for corrosion resistance, and for improved strength/ductility/fracture |
| | w/Ru | 1.0 | toughness balance in post-weld heat-treated GTA welds. |
| V | Lower | 5.2 | Meet min. Mo Equiv. to achieve min. YS (ageability) |
| | Upper | 6.2 | Max. Mo Equiv. to meet plate min. $K_{SCC}$ and min. weld KJ |
| Mo | Lower | 1.0 | Meet min. YS |
| | Upper | 1.7 | Max. Mo Equiv. to meet min. weld $K_J$ and plate min. $K_{SCC}$. Limit Mo to achieve (dilute) HCl corrosion resistance in Ru alloy variants. |
| Fe | Lower | 0.10 | Meet min. YS |
| | Upper | 0.25 | Max. Mo Equiv. to meet min. weld $K_J$, min. $K_{SCC}$, and dilute HCl corrosion resistance. Limit chemical segregation in large ingot melts. |
| O | Upper | 0.13 | Max. Al Equiv. to meet min. $K_{SCC}$ (minimize Alpha 2 phase) |
| N | Upper | 0.05 | Max. Al Equiv. to meet min. $K_{air}$ and $K_{SCC}$ |
| C | Upper | 0.03 | Max. Al Equiv. to meet min. $K_{air}$ and $K_{SCC}$ |
| Pd | Lower | 0.04 | Be crevice and SCC resistant to 550° F., meet min. $K_{SCC}$ and dilute HCl corrosion resistance |
| | Upper | 0.20 | Minimize cost of Pd addition |
| Ru | Lower | 0.06 | Be crevice and SCC resistant to 550° F., meet min. $K_{SCC}$ and dilute HCl corrosion resistance |
| | Upper | 0.20 | Minimize cost of Ru addition |
| Alum | Lower | 6.5 | To meet min. YS |
| Equiv. | Upper | 7.5 | To meet min. $K_{SCC}$ (minimize Alpha 2 phase) |
| Moly. | Lower | 5.0 | To meet min. YS (ageability) |
| Equiv. | Upper | 6.0 | To meet min. elongation, $K_{air}$, and $K_{SCC}$, and be fusion weldable |

TABLE 9

| Comparison of Series #2 (Sn—Mo) vs. Series #4 (Zr—Mo) Alloy Plate Weld Metal Properties | | | | | |
|---|---|---|---|---|---|
| Series # (Alloy Code) | Post Weld Heat Treatment* | UTS (ksi) | YS (ksi) | % Elong. (% RA) | $K_J$ (ksi √in) |
| Series #2 | 1400° F. | 159 | 150 | 4 (5) | 76 |
| (2C) | 1450° F. | 153 | 140 | 7 (10) | 55 |
| Series #2 | 1400° F. | 158 | 146 | 5 (10) | 49 |
| (2D) | 1450° F. | 156 | 144 | 6 (11) | 47 |
| Series #4 | 1400° F. | 155 | 144 | 6 (15) | 82 |

TABLE 11

| Non-Limiting Examples of Ti Alloy X Wrought Product Properties | | | | | |
|---|---|---|---|---|---|
| Product Form (Alloy Code) | Heat Treatment | UTS (ksi) | 0.2% YS (ksi) | Elong. [RA] (%) | 0.2% YS at 500° F. (ksi) |
| Transformed-Beta + STA Condition | | | | | |
| 0.5" plate (4G) | BA-AC* + 1400° F.-2 Hr-SC + 1000° F.-4 Hr-AC | 156 | 142 | 9.3 [17] | — |

TABLE 11-continued

Non-Limiting Examples of Ti Alloy X Wrought Product Properties

| Product Form (Alloy Code) | Heat Treatment | UTS (ksi) | 0.2% YS (ksi) | Elong. [RA] (%) | 0.2% YS at 500° F. (ksi) |
|---|---|---|---|---|---|
| | BA-SC** + 1400° F.-2 Hr-AC + 1000° F.-4 Hr-AC | 156 | 140 | 9.0 [18] | 100 |
| | BA-SC + 1400° F.-2 Hr-SC + 1000° F.-4 Hr-AC | 150 | 134 | 10.5 [20] | 95 |
| | BA-AC + 1400° F.-2 Hr-AC + 1000° F-4 Hr-AC | 154 | 140 | 9.0 | 106 |
| (4C) | BA-SC + 1400° F.-2 Hr-AC + 1000° F.-4 Hr-AC | 153 | 137 | 9.5 | 97 |
| | BA-SC + 1400° F.-2 Hr-SC + 1000° F.-4 Hr-AC | 146 | 131 | 10.0 | — |
| 1.25" plate (4G) | BA-AC + 1400° F.-2 Hr-AC + 1000° F.-4 Hr-AC | 154 | 138 | 8.3 [11] | — |
| | BA-SC + 1400° F.-2 Hr-AC + 1000° F.-4 Hr-AC | 152 | 135 | 9.3 [24] | — |
| | BA-SC + 1400° F.-2 Hr-SC + 1000° F.-4 Hr-AC | 147 | 130 | 10.5 [16] | — |
| (4C) | BA-AC + 1400° F.-2 Hr-AC + 1000° F.-12 Hr-AC | 150 | 134 | 9.5 [17] | — |
| | BA-SC + 1400° F.-2 Hr-AC + 1000° F.-4 Hr-AC | 148 | 132 | 9.3 [16] | — |
| 7.35" OD × 0.92" Wall Extruded Pipe | 1400° F.-2 Hr-OQ + 1000° F.-12 Hr-AC | 157 | 139 | 8 [18] | 99 |
| | 1600° F.-1 Hr-AC + 1000° F.-8 Hr-AC | 156 | 135 | 11 [27] | — |
| | 1600° F.-1 Hr-Fan Cool + 1000° F.-8 Hr-AC | 160 | 138 | 10 [25] | 98 |
| | Alpha-Beta + STA Condition | | | | |
| 0.5" plate (4C) | 1400° F.-4 Hr-FC to 1100° F.-AC | 143 | 138 | 15 [40] | — |
| (4K) | 1600° F.-30 min-WQ + 1100° F.-6 Hr-AC | 176 | 168 | 10.5 [31] | — |
| (4H) | 1550° F.-1 Hr-OQ + 1100° F.-12 Hr-AC | 161 | 157 | 12.5 [36] | — |
| | 1600° F.-30 Min-OQ + 1100° F.-12 Hr-AC | 171 | 165 | 12.5 [37] | — |
| (4J) | 1500° F.-1 Hr-Fan Cool 1100° F.-12 Hr-AC | 152 | 145 | 14.5 [34] | — |

*BA-AC = Beta Annealed, and cooled down at 13° F./sec.

**BA-SC = Beta Annealed, and cooled down at 1.8° F./sec.

TABLE 12

Fracture Toughness of Ti Alloy X Product Forms in Air and Seawater in Various Strength Conditions

| Product Form (Alloy Code) | Heat-Treat Condition | Yield Strength (ksi) | $K_Q$ (ksi √in) Air | $K_Q$ (ksi √in) Seawater | $K_{SCC}/K_{air}$ |
|---|---|---|---|---|---|
| 0.5" Plate (4B)* | BA + STA | 132 | 73.7 | 69.1 | 0.94 |
| 0.5" Plate (4C)* | BA + STA | 130 | 76.8 | 69.9 | 0.91 |
| 0.5" Plate (4C)* | BA + STA | 137 | 76.1 | 66.9 | 0.88 |
| 0.5" Plate (4C)* | BA + STA | 139 | 74.4 | 71.6 | 0.96 |
| 0.5" Plate (4C)* | BA + STA | 145 | 64.6 | 61.0 | 0.94 |
| 0.5" Plate (4G)* | BA + STA | 134 | 82.1 | 77.7 | 0.95 |
| 0.5" Plate (4H)* | BA + STA | 140 | 80.2 | 69.9 | 0.87 |
| 0.5" Plate (4J)* | BA + STA | 137 | 84.3 | 74.7 | 0.89 |
| 0.5" Plate (4K)* | BA + STA | 141 | 78.6 | 70.6 | 0.90 |
| 7.35" OD × 0.92" Wall | Extruded + STA | 133 | 82.0 | 65.4 | 0.80 |
| Riser Pipe* | Extruded + STA | 134 | 76.0 | 60.5 | 0.80 |
| | Extruded + STA | 138 | 67.1 | — | — |
| | Extruded + STA | 138 | 80.3 | — | — |

TABLE 12-continued

Fracture Toughness of Ti Alloy X Product Forms in Air and Seawater in Various Strength Conditions

| Product Form (Alloy Code) | Heat-Treat Condition | Yield Strength (ksi) | $K_Q$ (ksi √in) Air | $K_Q$ (ksi √in) Seawater | $K_{SCC}/K_{air}$ |
|---|---|---|---|---|---|
| 9.63" OD × 0.4" Wall Ti-6246 Alloy OCTG Pipe | Extruded + STA | 140 | 38.0 | 26.5 | 0.70 |

*Embodiment of Present Alloy

By way of nonlimiting example, the present alloy may be used to construct various components in the energy services fields, amongst others. Some nonlimiting exemplary components may be offshore piping and subsea flowlines; drill-pipe; offshore production, export, and re-injection risers and components; oil country tubular goods (OCTG) production tubulars and well casing and liners; offshore deepwater landing strings; offshore well-workover strings; offshore/marine fasteners and structural components; wellhead components; well jewelry (packers, safety valves, polished bore receptacles); well logging components and downhole equipment or tools; marine submersible components (ROVs-remote operating vehicles), amongst others that may benefit from the properties Ti Alloy X provides.

Figure 8:
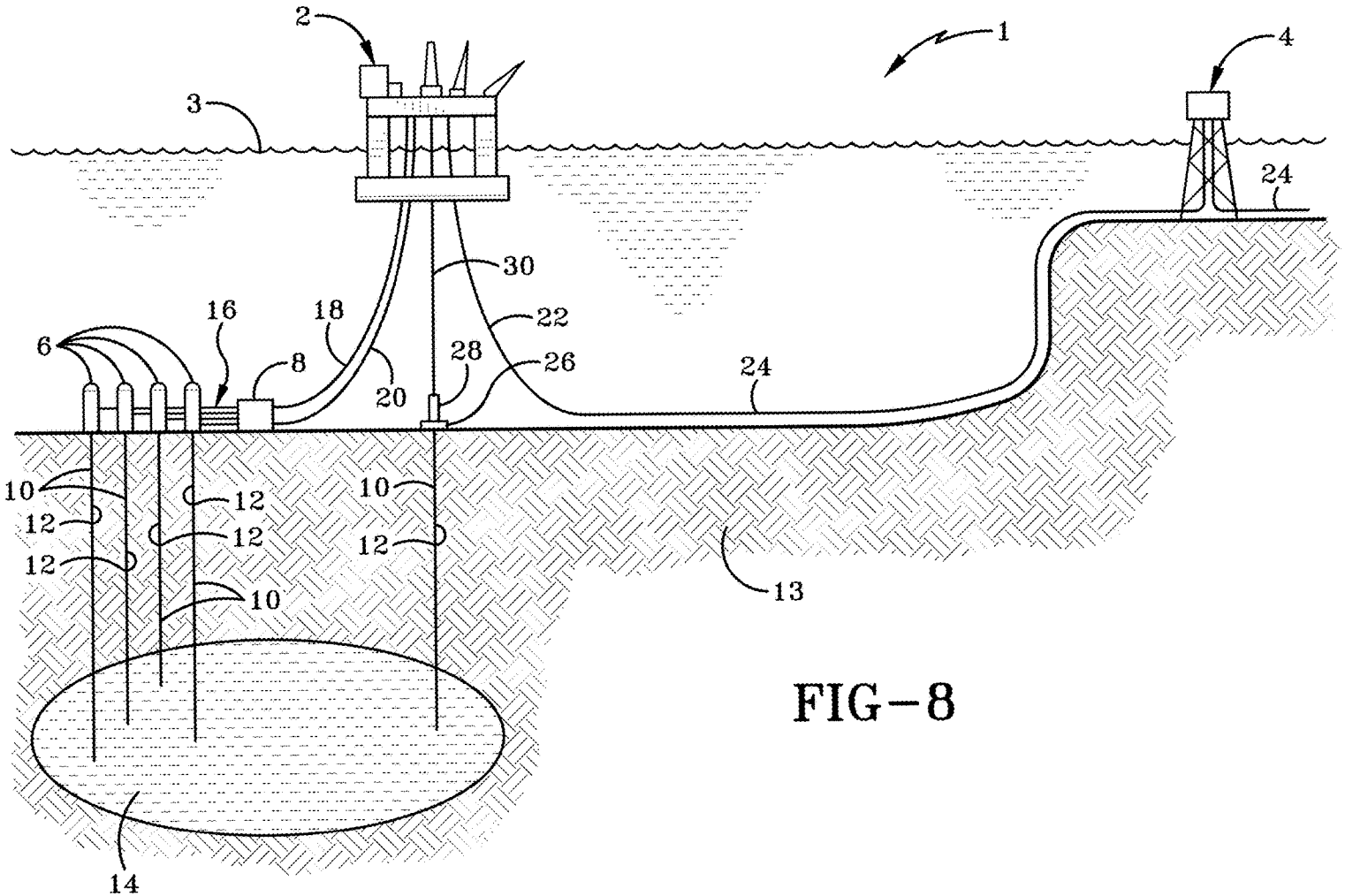
FIG. 8 is a diagrammatic view generally illustrating an offshore drilling and production system.

The figures illustrate some of the products or components which may be formed of the present alloy and some contexts in which these products or components may be used. FIG. 8 generally illustrates an offshore production and/or extraction system 1 which may be used in production and/or extraction of oil and gas (e.g., petroleum oil and natural gas), water, brine or other subsea fluids or gases. System 1 may be referred to as an offshore oil and gas production and/or extraction system, an offshore drilling and/or production system 1 or the like. System 1 may include an offshore floating platform 2 which may be disposed along the upper surface of an ocean, sea or seawater 3, a gravity based system or platform 4, and one or more subsea well heads 6.

System 1 may further include a subsea gathering manifold 8, and downhole equipment 10 including a casing and a production tubular within the casing extending down within a respective one of wellbores 12 in the seabed 13 below seawater 3 such that the wellbores 12 extend from the top of the seabed downward toward or into a hydrocarbon or oil and gas reservoir 14. System 1 may further include one or more subsea production pipelines or flow lines 16 which may extend from respective well heads 6 to manifold 8. System 1 may further include a production riser 18, a reinjection riser 20, an export riser 22 and one or more subsea pipelines 24. Although risers 18, 20 and 22 may extend above the surface of sea 3, a large portion of each of these risers is subsea or within salt water or seawater 3. Additional production pipelines or flow lines 16 may extend from manifold 8 to the bottom of risers 18 and 20. Each of risers 18, 20 and 22 extends upwardly and is connected to platform 2 adjacent the top ends of said risers. Each of risers 18, 20 and 22 may be catenary risers. One end of export pipeline or flow line 24 may be connected to or adjacent the lower end of export riser 22 such that riser 22 and pipeline 24 are in fluid communication. Each of production riser 18 and reinjection riser 20 may be in fluid communication with manifold 8 and respective flow lines 16, well heads 6, downhole equipment 10 and reservoir 14.

System 1 may also be configured with a subsea well head 26 which is essentially directly below platform 2. System 1 may include a blowout preventer 28 adjacent well head 26 and a drilling riser or riser assembly 30 extending downwardly from platform 2 through well head 26 and blowout preventer 28 into seabed 13 as downhole equipment 10 to form a wellbore 12 in seabed 13 which extends downwardly toward or into reservoir 14. Riser assembly 30 may include a riser with a drill string or drill pipe within the riser. Alternately, riser assembly 30 may include a casing with a production tubular or landing string within the casing.

Figure 9:
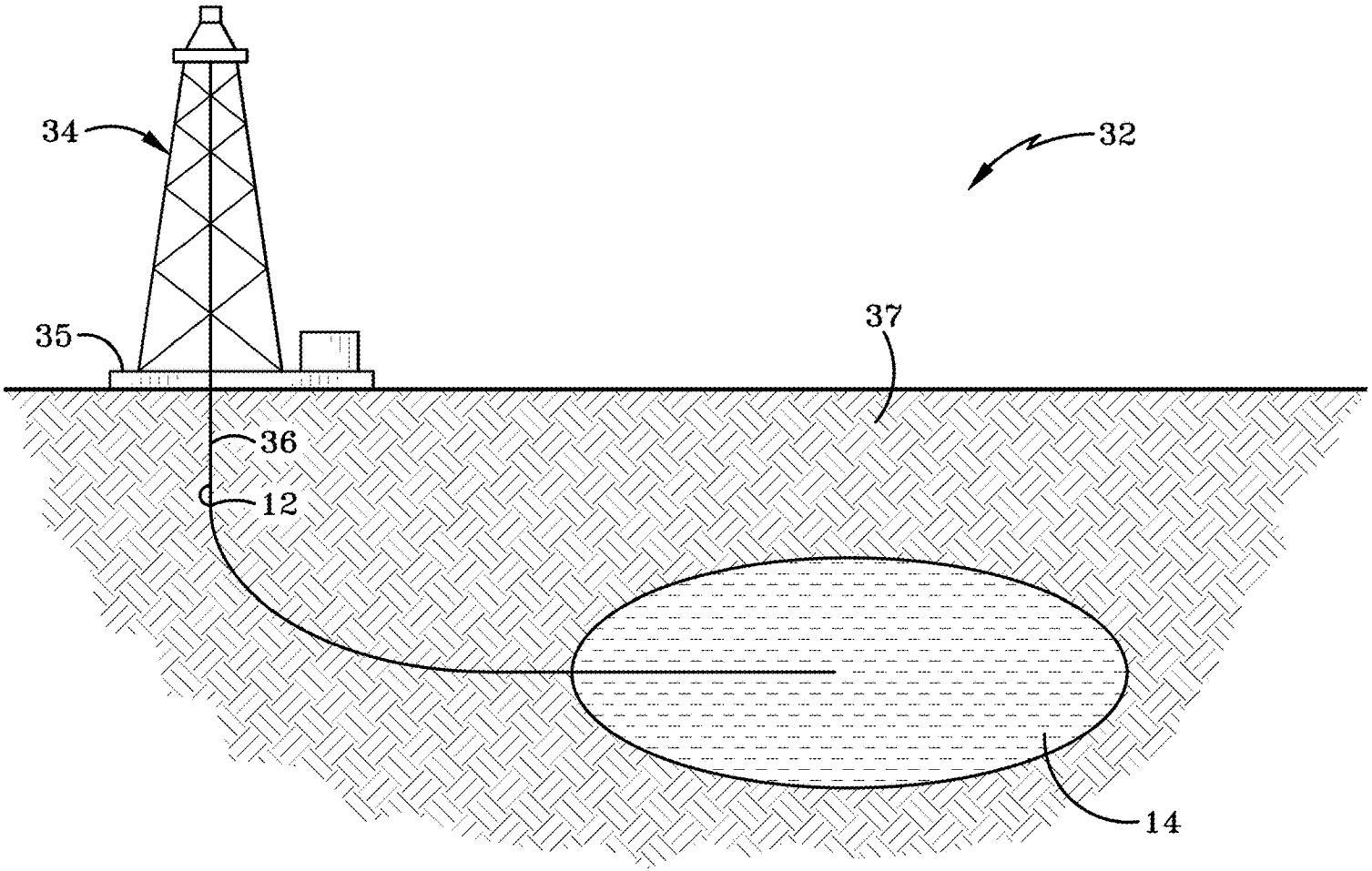
FIG. 9 is a diagrammatic view generally illustrating a land based drilling and production system.

FIG. 9 generally illustrates a land-based or on-shore production and/or extraction system 32 which may be used in production and/or extraction of oil and gas (e.g., petroleum oil and natural gas), water, brine or other underground fluids or gases. System 32 may be referred to as a land-based or onshore oil and gas production and/or extraction system, a land-based or onshore drilling and/or production system 32 or the like. System 32 may include an on-shore or land-based platform or drilling rig 34 and downhole equipment or casing and drill string or drill pipe 36 which may extend down into the earth, land or ground 37 in order to form a wellbore 12 extending from well head 35 and the surface of ground 37 to an underground hydrocarbon or oil and gas reservoir 14, which may also be a hot brine reservoir, etc. Drill pipe 36 or a portion thereof may also be used as a landing string. The wells 12 and reservoirs 14 of FIGS. 8 and 9 may be HPHT or XHPHT hydrocarbon wells or reservoirs.

Figure 10:
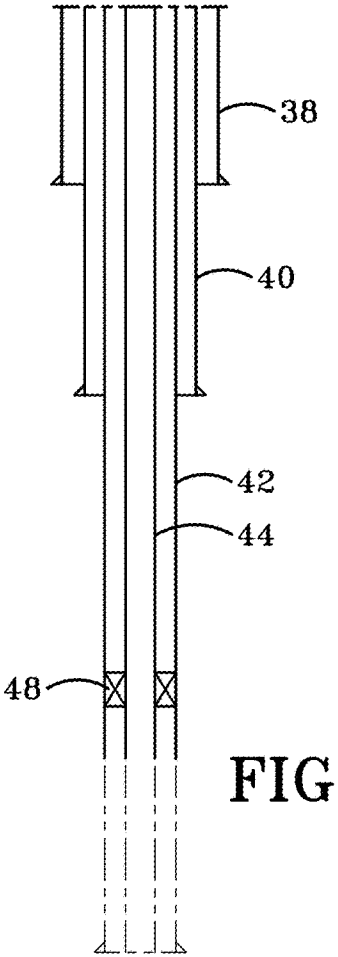
FIG. 10 is a diagrammatic view generally illustrating downhole equipment.

FIG. 10 illustrates various tubular components which may be production components or production related components which may include downhole equipment such as used in the context discussed with respect to FIGS. 8 and 9. These tubular components may include a surface casing 38, an intermediate casing 40 having an outer diameter smaller than the inner diameter of casing 38 such that casing 40 extends within casing 38, a production casing 42 which has an outer diameter which is smaller than the inner diameter of intermediate casing 40 such that production casing 42 extends within casing 40 and casing 38, and a production tubular 44 having an outer diameter which is smaller than the inner diameter of production casing 42 such that production tubular 44 extends within casing 42, 40 and 38. A packer 48 may be disposed within production casing 42 extending from the inner surface of casing 42 to the outer surface of production tubular 44.

Figure 11A:
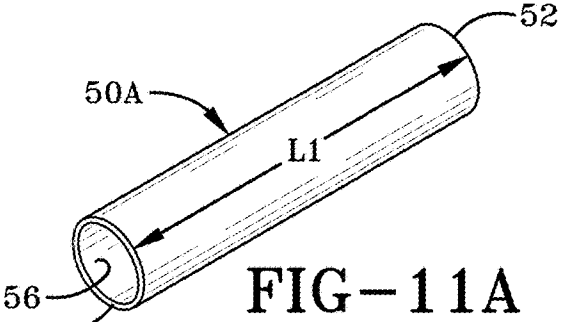
FIG. 11A is broadly an isometric view a non-threaded pipe segment or tubular segment which may not be drawn to scale for purposes of illustration.
Figure 11B:
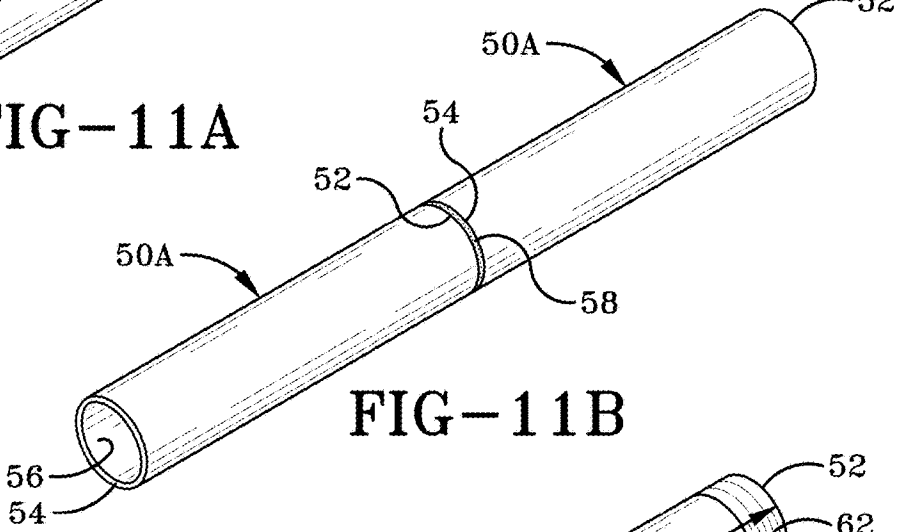
FIG. 11B is broadly an isometric view two of the non-threaded pipe segments of FIG. 11A which are joined by a weld and may not be drawn to scale for purposes of illustration.
Figure 11C:
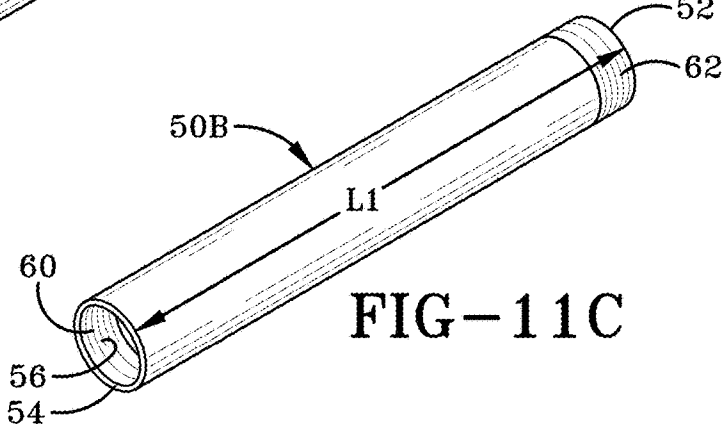
FIG. 11C is broadly an isometric view a threaded pipe segment or tubular segment which may not be drawn to scale for purposes of illustration.

FIGS. 11A-11C illustrate tubular segments or pipe segments 50A and 50B which may be formed of the present alloy. Segments 50 are generally intended to illustrate tubular segments or pipe segments which may be used to form the various tubular components discussed with respect to FIGS. 8-10, such as downhole equipment/casing/landing string/drill pipe/drill string 10, production pipelines or flow lines 16, production riser 18, reinjection riser 20, export riser 22, export pipeline or flow line 24, riser assembly 30, downhole equipment or tools/drill pipe/drill string 36, production casing 42 and production tubular 44. FIG. 11A shows a single pipe segment 50A having first and second ends 52 and 54 such that the inner surface of pipe segment 50A defines a through passage 56 extending from first end 52 to second end 54. First and second ends 52 and 54 define therebetween a length L1 of segment 50A. Segment 50A may be a cylindrical pipe segment and have non-threaded ends 52 and 54. FIG. 11B illustrates two pipe segments 50A which are welded together at a butt weld 58 to form a longer pipe segment such as may be used in forming the various tubular components discussed above. FIG. 11C shows that pipe segment 50B is similar to pipe segment 50A in having first and second ends 52 and 54 such that the inner surface of pipe segment 50B defines a through passage 56 extending from end 52 to end 54. Segment 50B may include an internally threaded section 60 adjacent one end 54 and an externally threaded section 62 adjacent the other end 52. FIGS. 11A and 11C illustrate some simple tubular segments which may be used in the various tubular components discussed above. However, it will be understood by one skilled in the art that numerous other configurations of pipe segments may be used. For instance, generally similar pipe segments may be formed such that different sections of the pipe segment has different outer diameters. Further, a pipe segment similar to pipe 50B may be formed with internally threaded sections adjacent both ends 52 and 54, or alternately with externally threaded sections 62 adjacent both ends 52 and 54. Thus, for instance two pipe segments 50B may be threaded together with the externally threaded section 62 of one segment 50B threadedly engaging an internally threaded section 60 of another segment 50B. On the other hand, threaded couplers may also be used between various pipe segments such that for instance, an externally threaded section of a pipe segment may threadedly engage an internally threaded section of a coupler, while an externally threaded section of another pipe segment may likewise threadedly engage an internally threaded section of a coupler so that the two pipe segments are joined to one another via the threaded connections to the coupler. Likewise, some of the pipe segments used in various tubular components may have annular flanges which extend radially outwardly from the ends of a given pipe segment whereby such flanges are used to join such pipe segments to one another, such as with bolts or other fasteners. Thus, the pipe segments as shown in FIGS. 11A-11C are intended to include the various types of pipe segments which are known in the art and used to produce the various tubular components discussed above or tubular portions of such components. For instance, pipe segments 50A and 50B may be drill pipe segments, landing string segments, well-workover string segments, riser segments, well casing segments, production tubular segments, and subsea pipeline or flow line segments.

The present alloy may be formed as a component (such as those discussed previously) which is used in various contexts. Such a component may have an operational position or condition such as being submerged in or in contact with seawater or various other aqueous chloride media (e.g., a chloride-containing brine), hydrogen sulfide-containing fluid and/or carbon dioxide-containing fluid. The component in the operational position or condition may be under a pressure of at least 1,200 psi, 1,500 psi, 2,000 psi, 3,000 psi, 4,000 psi, 5,000 psi, 10,000 psi, 15,000 psi or 20,000 psi at a temperature of at least 120° F., 150° F., 200° F., 300° F., 400° F., 500° F. or 600° F. The component may be submerged in or in contact with the above-noted fluids and/or at the above-noted pressure and/or at the above-noted temperature continuously for extended periods, for instance, an hour, 12 hours, 24 hours, a week, a month, a year or more. The components may likewise be used continuously at cooler temperatures, for example at room temperature (about 77° F.) or an ambient temperature, or such as in ocean water or seawater in which the temperature may range from about 28° F. to about 100° F.

One or more methods may include operating or maintaining a production and/or extraction system (such as those described above) comprising the component so that the component is under the various operational conditions noted above. Such a system may include a drilling rig or system (e.g., part of platform 2 or 34) which rotates a drill string or pipe such as drill string/pipe 30 (FIG. 8) or 36 (FIG. 9) to drill a well or wellbore such as wells or wellbores 12 of FIGS. 8 and 9. Such a system may also include one or more pumps for pumping various fluids (and solids) through tubular components such as risers 18, 20, 22 and 30, production pipeline or flow line 16, export pipeline or flow line 24, drill string or pipe 30, 36 or 44 or casing 42.

Thus, a method may include operating or maintaining a production and/or extraction system comprising the component such that during the step of operating the production and/or extraction system, the component is submerged in or in contact with aqueous chloride media, seawater, a hydrogen sulfide-containing fluid (e.g. drilling fluid), a carbon dioxide-containing fluid (e.g. drilling fluid) and/or such that the component is continuously maintained (such as for an hour, 12 hours, 24 hours, a week or more) at a pressure of at least 1,200 psi, 1,500 psi, 2,000 psi, 3,000 psi, 4,000 psi, 5,000 psi, 10,000 psi, 15,000 psi or 20,000 psi and/or at a temperature of at least 120° F. 150° F., 200° F., 300° F., 400° F., 500° F. or 600° F. Such components may be used in hydrocarbon reservoirs/wells which are HPHT or XHPHT, which may have a bottomhole temperature of at least about 300° F. and a bottomhole pressure at least about 10,000 psi (HPHT) or a bottomhole temperature of at least about 400° F. and a bottomhole pressure of at least about 20,000 psi (XHPHT). Such components may also be used in hot brine wells/reservoirs or other wells/reservoirs.

It is noted that the aqueous chloride media noted above may have a wide range of chloride ion concentration, for instance, about 1 (one) part per million (ppm) up to full saturation. Even very low chloride ion concentrations may have substantial deleterious effects on many known titanium alloys. The aqueous chloride media thus may include seawater and various brines such as well fluids. Seawater may have a chloride ion concentration in a range of about 18,000 to about 23,000 or 24,000 milligrams per liter (mg/L). Aqueous chloride media herein may be an aqueous chloride solution having a chloride ion concentration of at least 1 (one) ppm or may be substantially higher, such as at least 10 mg/L, 100 mg/L, 500 mg/L, 1000 mg/L, 5000 mg/L, 10,000 mg/L, 15,000 mg/L or more.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration set out herein are an example not limited to the exact details shown or described.

The invention claimed is:

1. A titanium alloy consisting essentially of:
aluminum from 5.0 to 6.0% by weight;
zirconium from 3.75 to 4.75% by weight;
vanadium from 5.2 to 6.2% by weight;
molybdenum from 1.0 to 1.5% by weight;
iron from 0.10 to 0.25% by weight;
one of palladium from 0.04 to 0.20% by weight and ruthenium from 0.06 to 0.20% by weight;
by weight no more than: 0.13% oxygen, 0.05% nitrogen, 0.03% carbon, 0.015% hydrogen, 0.015% boron, and 0.1% tin; and
a titanium remainder balance,
wherein:
the titanium alloy has a molybdenum equivalency in a range of 5.0 to 5.9, wherein the molybdenum equivalency=molybdenum weight % in the alloy+(0.67)(vanadium weight % in the alloy)+(2.5)(iron weight % in the alloy);
the titanium alloy has an aluminum equivalency in a range of 6.5 to 7.5, wherein the aluminum equivalency=aluminum weight % in the alloy+(0.33)(tin weight % in the alloy)+(0.17)(zirconium weight % in the alloy)+(10.0)(oxygen weight % in the alloy);
and wherein, when in the form of a solution heat treated and aged 0.5 inch plate:
(a) the titanium alloy has a yield strength of at least 130 ksi at room temperature;
(b) the titanium alloy has a density of ≤0.165 lb/in$^3$;
(c) the titanium alloy has a fracture toughness at room temperature in air and seawater of at least 50 ksi √in;
(d) in 25-33% NaCl brine at a temperature of at least 550° F., the titanium alloy achieves:
(i) a sour/air ductility reduction in area ratio of ≥0.90 by slow strain rate test (SSRT) according to NACE TM 0198-2011;
(ii) a sour/air ductility time to failure ratio of ≥0.90 by SSRT according to NACE TM 0198-2011; and
(iii) a brittle fracture area of <2% of total area;
(e) at room temperature, an after post-weld heat treatment weld of the titanium alloy has:
(i) a fracture toughness in air of at least 55 ksi √in; and
(ii) an elongation of at least 4.0%; and
(f) a corrosion rate of the titanium alloy after 24 hours in boiling 2 wt. % HCl is ≤20 mils per year.

2. The titanium alloy of claim 1 wherein a total amount of any single element in the titanium alloy other than titanium, aluminum, zirconium, vanadium, molybdenum and the one of palladium and ruthenium is no more than 1.0% by weight.

3. The titanium alloy of claim 1 wherein the titanium alloy has no local crevice attack after the alloy has been submerged for 60 days in naturally-aerated seawater which has a pH of 3 and is maintained at a temperature of 500° F. throughout the 60 days.

4. The titanium alloy of claim 1 wherein the titanium alloy has a yield strength of at least 90 ksi at a temperature of 500° F.

5. The titanium alloy of claim 1 wherein the titanium alloy is formed as a tubular component.

6. The titanium alloy of claim 1 wherein the titanium alloy is formed as a component which comprises at least a portion of one of an offshore pipe, a subsea flow line, a drill pipe, an offshore riser, an oil country tubular goods (OCTG) production tubular, an OCTG well casing, an offshore landing string, an offshore well-workover string and downhole equipment.

7. The titanium alloy of claim 1 wherein the titanium alloy is formed as a component having an operational position in which the component is in contact with aqueous chloride media.

8. The titanium alloy of claim 1 wherein the titanium alloy is formed as a component having an operational position in which the component is under a pressure of at least 1,200 psi.

* * * * *